US007828679B2

(12) United States Patent
Tell et al.

(10) Patent No.: US 7,828,679 B2
(45) Date of Patent: Nov. 9, 2010

(54) TOY FOR POSITIONING A PLAY IMPLEMENT

(75) Inventors: Robert Tell, Orchard Park, NY (US); David B. Fisher, Orchard Park, NY (US); Scott H. McIlvain, Holland, NY (US); Ross Rumfola, III, Akron, NY (US)

(73) Assignee: Mattel, Inc., El Segundo, CA (US)

( * ) Notice: Subject to any disclaimer, the term of this patent is extended or adjusted under 35 U.S.C. 154(b) by 494 days.

(21) Appl. No.: 11/757,240

(22) Filed: Jun. 1, 2007

(65) Prior Publication Data

US 2008/0300070 A1 Dec. 4, 2008

(51) Int. Cl.
*A63B 69/00* (2006.01)

(52) U.S. Cl. ..... 473/417; 473/419; 473/428

(58) Field of Classification Search ..... 473/132, 473/137, 147, 417, 419, 418, 429, 430; 221/281
See application file for complete search history.

(56) References Cited

U.S. PATENT DOCUMENTS

| | | | | |
|---|---|---|---|---|
| 2,159,122 | A | 5/1939 | Armstrong | |
| 3,206,067 | A * | 9/1965 | Smith, Jr. et al. | 221/281 |
| 3,397,885 | A * | 8/1968 | Nash, Jr. | 473/418 |
| 3,529,823 | A | 9/1970 | Garver | |
| 3,738,662 | A * | 6/1973 | Hodgin | 473/133 |
| 3,940,132 | A | 2/1976 | Lopatto, III | |
| 3,999,753 | A * | 12/1976 | Desilets et al. | 473/418 |
| 4,146,232 | A * | 3/1979 | Stone | 473/137 |
| 4,424,969 | A * | 1/1984 | Dumas | 473/419 |
| 4,796,893 | A | 1/1989 | Choi | |
| 4,834,375 | A | 5/1989 | Elstein et al. | |
| 4,892,318 | A * | 1/1990 | Jennings | 473/137 |
| 5,259,622 | A | 11/1993 | Irving | |
| 5,427,369 | A * | 6/1995 | Baquet, Jr. | 473/429 |
| 5,464,223 | A * | 11/1995 | Dermott | 473/134 |
| 5,665,004 | A * | 9/1997 | Vlahovic | 473/137 |
| 5,746,667 | A | 5/1998 | Fraser et al. | |
| 6,695,723 | B2 | 2/2004 | Leal et al. | |
| 6,729,978 | B2 | 5/2004 | Moss et al. | |

FOREIGN PATENT DOCUMENTS

JP 10234915 9/1998

OTHER PUBLICATIONS

"New Schutt Striker II Baseball Batting Training Aid" webpage printout from http://cgi.ebay.com/New-Schutt-Striker-II-Baseball-Batting-Training-Aid_W0QQitemZ230165875981QQihZ013QQ-categoryZ..., 9 pages.
"Paddle Tetherball Set" webpage printout from http://www.shapeupshop.com/games/tetherball/paddle_tetherball.htm, 2 pages.

* cited by examiner

*Primary Examiner*—Gene Kim
*Assistant Examiner*—M Chambers
(74) *Attorney, Agent, or Firm*—Edell, Shapiro & Finnan LLC

(57) ABSTRACT

The present invention discloses a play implement positioning device including an implement support for holding a first play implement in a play position to be struck. The invention also discloses a mechanism for selectively, automatically placing multiple stored play implements onto the implement support after the first implement has been struck and dislodged from the implement support.

32 Claims, 31 Drawing Sheets

TOY FOR POSITIONING A PLAY IMPLEMENT

BACKGROUND OF THE INVENTION

The present invention relates to a baseball device that positions and holds a first play implement in a play position ready to be put into play. The device includes a loader that stores a second play implement and that places the second play implement into the play position after the first play implement is put into play.

Baseball players practice batting by swinging repeatedly at pitches. However, some younger players have not yet developed the hand-eye coordination skills necessary to successfully swing at and hit pitched balls. Even so, these younger players may engage in batting practice by swinging at stationary play implements (balls) that are placed in a stationary play position. Play implements can be supported in a play position by releasably placing the play implement on the upper end of a vertical post/rod extending upward from the ground. Play implements may also be supported in the play position by suspending the play implement from the lower end of an elongated member which is supported at its upper end by an upper support. Often, players have difficulty with placing a play implement on top of the vertical post/rod.

For example, the device could include an implement support that extends over the play position. The device could further include a flexible elongate member including a first upper end and a second lower end. The first upper end could be connected to the implement support and the second lower end could be releasably connected to the play implement to suspend the play implement in the play position ready to be struck by a batter.

When the play implement is in the play position, a player can swing a bat and hit the play implement, disconnecting it from the device. By repeatedly swinging the bat and hitting the play implement players can develop improved hand-eye coordination. Unfortunately, in baseball, a player swings and hits the play implement (ball) away from himself. This means that during a practice session, a player must retrieve the play implement each time successful contact is made. The result is that the better a player gets at making contact with the play implement, the more time they have to spend retrieving the play implement (ball) and not practicing.

In addition, the use of a conventional batting tee involves the repeated resetting of the tee after it has been struck by a player. Typically, younger players hit the support member, such as a batting tee, instead of the play implement on the tee because the support member is below the play implement. The result is usually that the player knocks over the support member, but does not contact the play implement. In that case, the support member and the play implement will both need to be reset prior to the player being able to swing at another play implement. The combination of collecting a play implement after each hit and the need to reset frequently the support member results in frustration for the player as well as any parent or other individual who is involved. That frustration coupled with the difficulty that young players have with resetting a play implement on a support member typically results in a player stopping play with the device altogether.

There is therefore a need to develop a device capable of storing several play implements at one time for convenient replacement of a stored play implement into the play position after the previous implement is put into play. Furthermore, there is a need to develop a device capable of selectively and automatically positioning a replacement play implement in the play position when the previous play implement has been struck. Additionally, there is a need to develop a device that provides a convenient manner in which a player can practice hitting and that reduces the frustration associated with frequently resetting a support member such as a batting tee.

SUMMARY OF THE INVENTION

Generally, the present specification discloses a play implement positioning device that releasably holds a play implement in a play position ready to be struck by a baseball bat. The device includes an implement support that extends over the play position and from which the play implement is suspended in the play position. In one embodiment, the play position can be a fixed or reasonably stationary play position so that a player can become comfortable with and used to the particular play position. The present invention also includes a loader having a storage member that stores multiple play implements or balls. The loader includes an electromechanical device that selectively and automatically positions one of the stored play implements on the implement support after a previous play implement has been struck. The device further includes an electronic controller for controlling automatic operation of the device.

In operation, a player places several play implements in the storage member of the device's loader. The player then presses a conveniently located actuator or button on the device which sends a signal to the electronic controller to generate sensory stimulation (e.g., lights and/or sounds) and to load a play implement into play position. Specifically, a play implement is loaded into play position when the electronic controller energizes the electromechanical device to move a play implement from a storage position to the play position where the play implement comes in contact with and becomes releasably connect to the implement support.

The device according to the present invention provides a convenient solution to providing hitting practice for a player. The device reduces the need to collect a play implement after each hit. Additionally, the device reduces the frustration associated with resetting a batting tee after it is knocked over by the player. The device allows a player to spend more time hitting a play implement and less time chasing play implements and resetting a batting tee.

BRIEF DESCRIPTION OF THE DRAWINGS

Like reference numerals have been used to identify like elements throughout this disclosure.

DETAILED DESCRIPTION OF THE INVENTION

Figure 1:
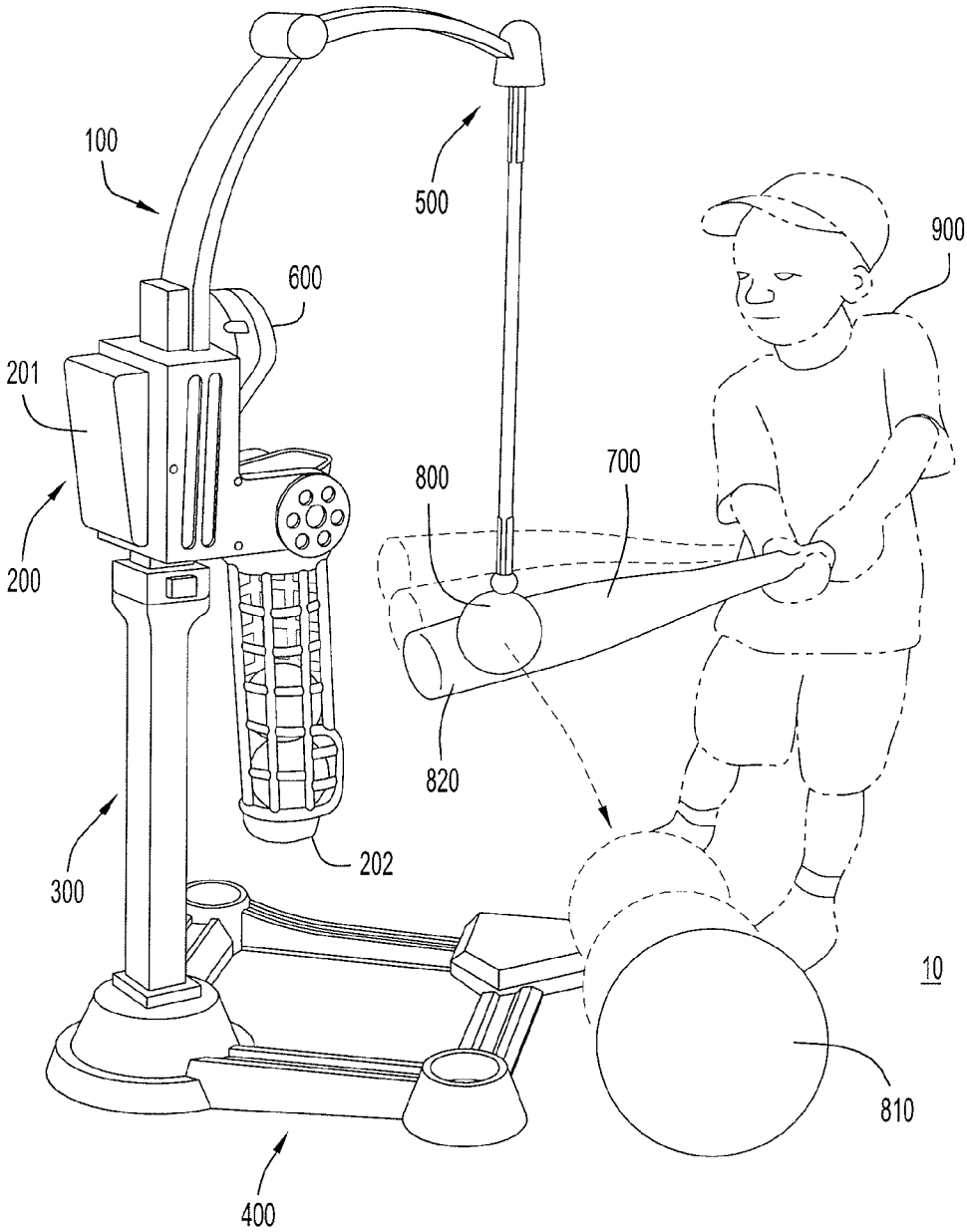
FIG. 1 illustrates a perspective view of an embodiment of the play implement positioning device in a non-load configuration with a play implement being struck by a child.

In accordance with the present invention, a play implement positioning device 100 is disclosed. The general features of the play implement positioning device 100 will now be discussed as they relate to FIGS. 1 and 2. FIG. 1 shows a play implement 800 releasably suspended in a play position 820 from an implement support 500. The implement support 500 has a first end that is coupled to a support surface engagement member 400 and a second end to which the play implement 800 can be coupled, as described in detail below. In this embodiment, the play implement 800 is a baseball which can be soft or semi-hard. Also illustrated is a struck play implement 810 shown in a position after the play implement 810 has been struck and disengaged from the implement support 500. The implement support 500 is elevatable to an appropriate height by an elevation member 300. In addition, the elevation member 300 is held and supported by a support surface engagement member 400 on a support surface 10. FIG. 1 also shows a child 900 swinging a bat 700 into contact with the play implement 800. When the bat 700 makes contact with the play implement 800, the play implement 800 releases form the implement support 500 and travels away from the play implement positioning device 100.

Figure 2:
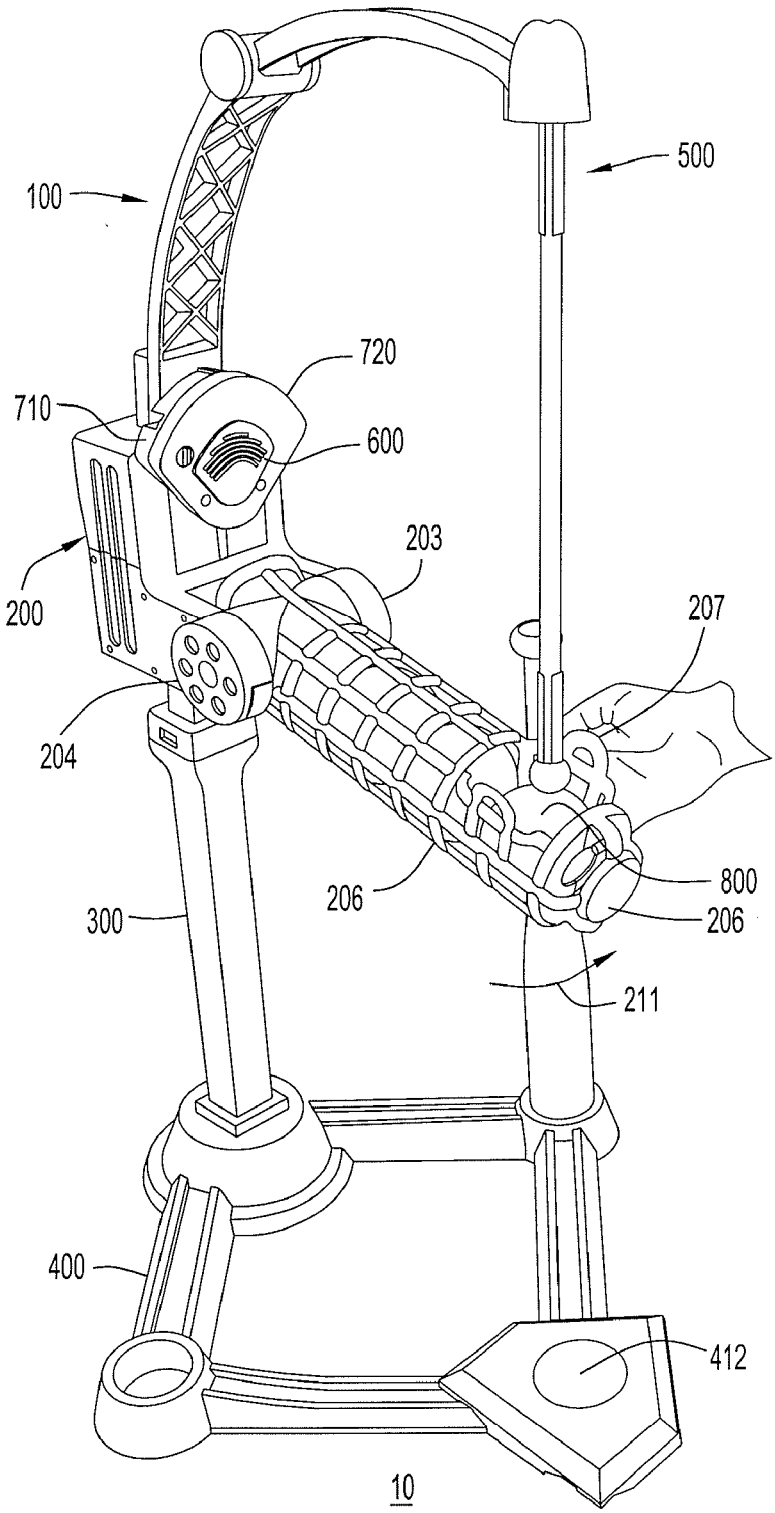
FIG. 2 illustrates a perspective view of the play implement positioning device of FIG. 1 showing the device in the load or loading position.

After the play implement 800 is dislodged from the implement support 500, the child 900 can send a signal to the electronic controller 600 to instruct a loader or ball loading device 200 to load another play implement 800 into the play position 820. The loader or ball loading device 200 includes a base connector 201 and a storage member 202. As described in detail below, the ball loading device 200 is configured to receive and retain multiple play implements or ball therein. The storage member 202 has an upper end pivotally connected to left and right hinges 203, 204 respectively of the base connector 201 (see FIG. 2). The lower end 206 of the storage member 202 can pivot about an axis extending through the left and right hinges 203, 204. FIG. 1 shows the storage member 202 in a substantially vertical rest position or non-load or non-loading position. FIG. 2 shows the storage member 202 in a substantially horizontal position or load or loading position. The storage member 202 can be automatically pivoted between the non-load position of FIG. 1 and the load position of FIG. 2 by a drive mechanism (discussed in more detail below). The drive mechanism transmits a force to the upper end of the storage member 202 at the left and right hinges 203, 204, thereby causing the storage member 202 to pivot relative to the support.

As mentioned above, when the child desires to swing at another positioned play implement, the child 900 signals the loader or ball loading device 200 to load another play implement 800 onto the implement support 500 by pressing actuator or button 412 (e.g., with their foot; see FIG. 2). Pressing actuator or button 412 signals the electronic controller 600 to instruct the motorized mechanism to pivot the storage member 202 from the non-load position of FIG. 1 to the load position of FIG. 2 (directionally designated in FIG. 2 with loading direction arrow 211) and then back to the non-load position of FIG. 1. In the non-load position illustrated in FIG. 1, the storage member 202 is configured such that play implements 800 fall by force of gravity toward the second end 206 of the storage member 202. Also shown in FIG. 2, the storage member 202 has a lower opening 207 large enough for a play implement to pass through. The lower opening 207 is in communication with the interior region 227 of the storage member 202.

When the storage member 202 is pivoted to the load position (shown in FIG. 2), a play implement 800 that has fallen to the lower end 206 of the storage member 202 is brought into contact with the implement support 500. The opening 207 proximate to end 206 of the storage member 206 is positioned proximate to the implement support 500 and in particular, the connector or connection mechanism on the implement support 500. When the play implement 800 makes contact with the implement support 500, a connection force (discussed in greater detail below) at the point of contact resists separation so that the play implement is releasably held onto implement support 500 in the play position 820. When the storage member 202 is again pivoted back to the non-load position, the connection force between the implement support 500 and the play implement 800 pulls play implement 800 through lower opening 207 to remain releasably connected to the implement support 500 as shown in FIG. 1. The play implement 800 is now ready to be swung at by a child 900. Furthermore, in the non-load position, the lower end 206 of the storage member 202 is pivoted out of the way of the loaded play implement 800 to prevent unintended contact between the bat 700 and the storage member 202.

In addition to sending an instruction to pivot the storage member 202, when the actuator or button 412 is pressed, the electronic controller 600 generates an output such as a light through light emitters and/or sounds through speaker 720. For, example the electronic controller 600 can generate sound simulating cheering at a baseball field or voices (e.g., saying "batter up"). Furthermore, on/off switch 710 is actuated to energize the play implement positioning device 100 and thereafter sounds and lights may automatically be generated by the electronic controller 600.

Figure 3:
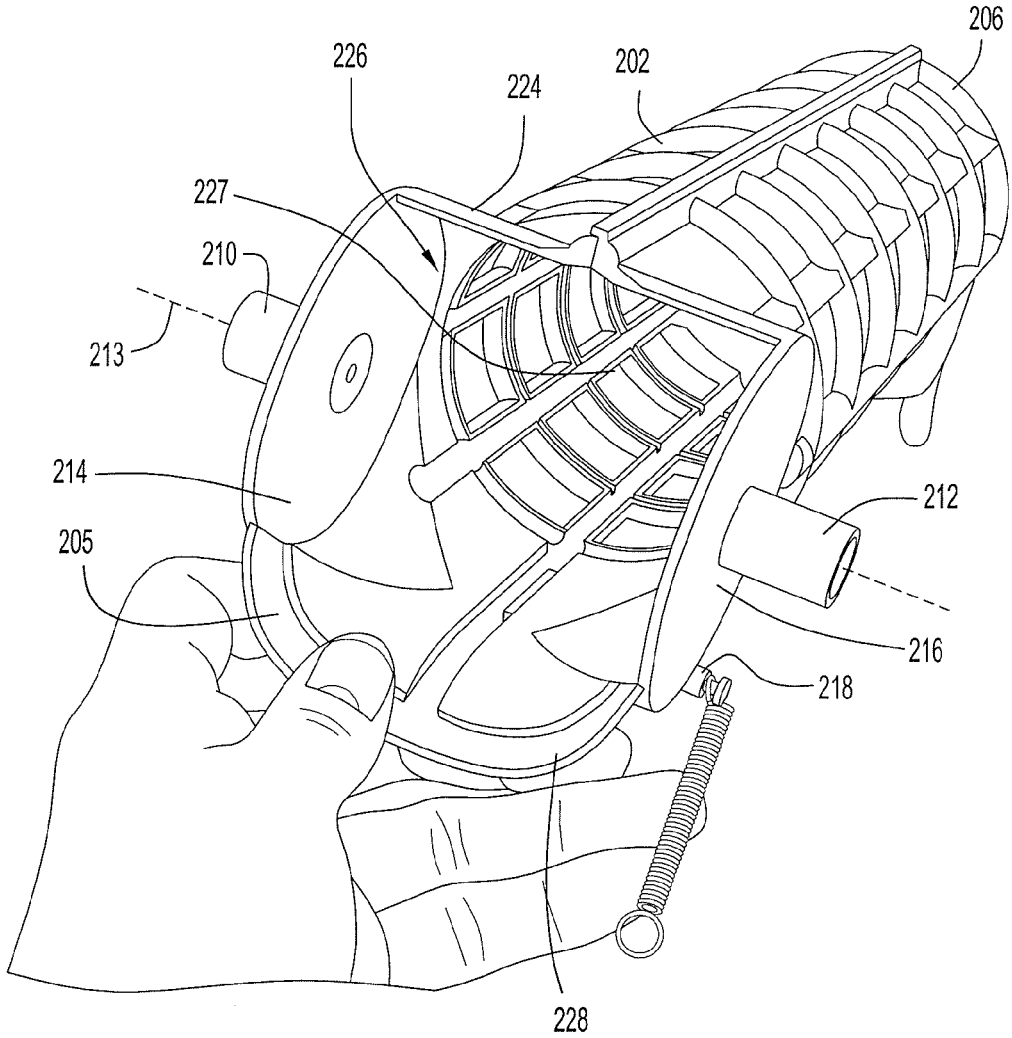
FIG. 3 illustrates an enlarged perspective view of a storage member of the play implement positioning device of FIG. 1.

FIG. 3 shows an enlarged view of the storage member 202. As discussed above, the storage member 202 includes a second end 206. Opposite the second end 206 of the storage member 202 is a first end 205 having an upper opening 226 defined by a cage rim 224. The cage rim 224 includes a loading lip 228 shaped to more easily accommodate play implements 800 being loaded into the first end 205 of the storage member 202. The upper opening 226 leads to and is in communication with an interior region or tubular space 227 such that play implements 800 passing through the upper opening 226 pass into and are stored in the interior region 227. When the storage member 202 is in its non-load position, play implements 800 fall toward the lower opening 207.

On either side of the upper end 205 of the storage member are left and right plates 214 and 216, respectively. Attached to each of left and right plates 212, 214 are respective left and right axles 210, 212. The left and right axles 210, 212 extend outwardly from the left and right plates 212, 214 to define the axis 213 about which the storage member 202 pivots between the non-load position (FIG. 1) and the load position (FIG. 2). As storage member 202 moves between the non-load position and the load position, it moves in a substantially vertical plane 220. An arm connector 218 is also connected to the right plate 216 at a distance offset from the right axle 212. A motorized mechanism discussed below applies a force to the arm connector 218 to pivot the storage member 202 between the non-load (FIG. 1) and load (FIG. 2) positions. The process of motorized pivoting of the storage member 202 will be described in greater detail below.

Figure 4:
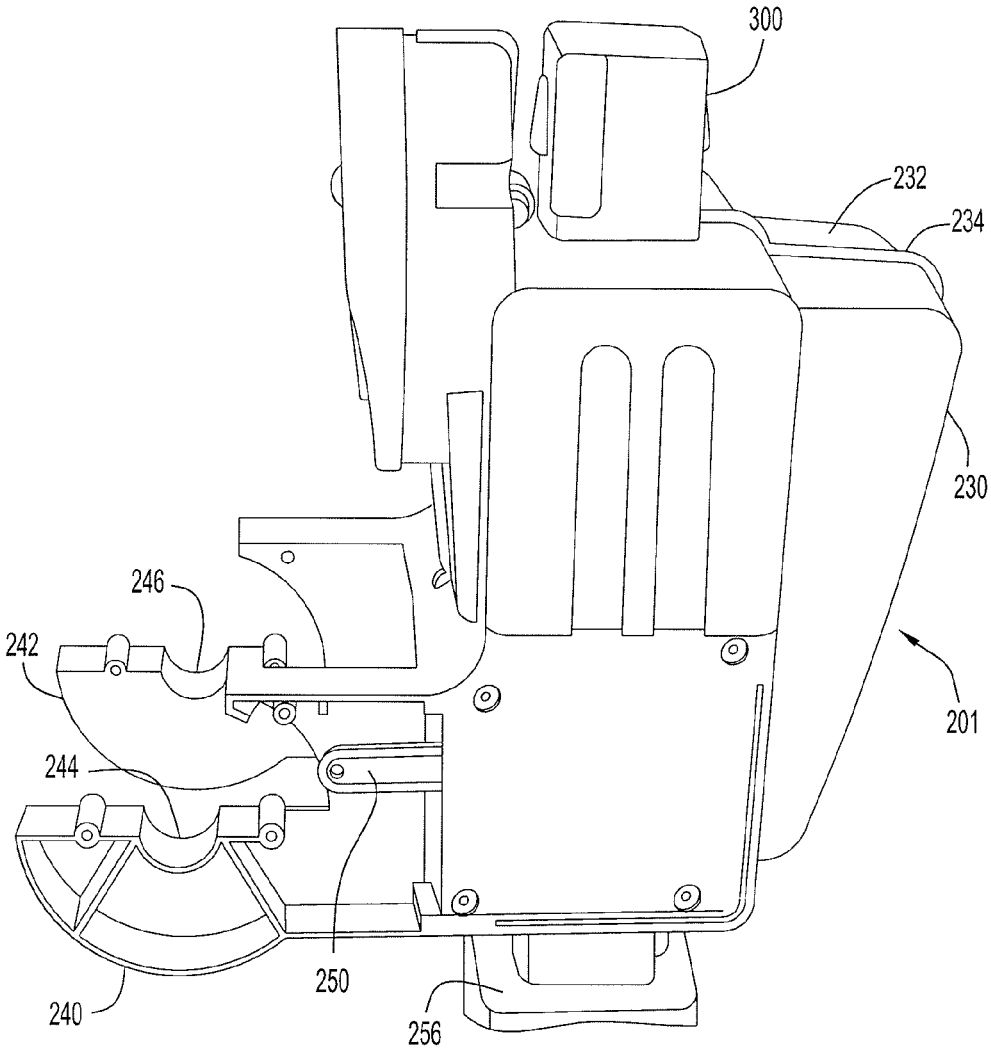
FIG. 4 illustrates a side perspective view of a base connector of the play implement positioning device of FIG. 1.
Figure 5:
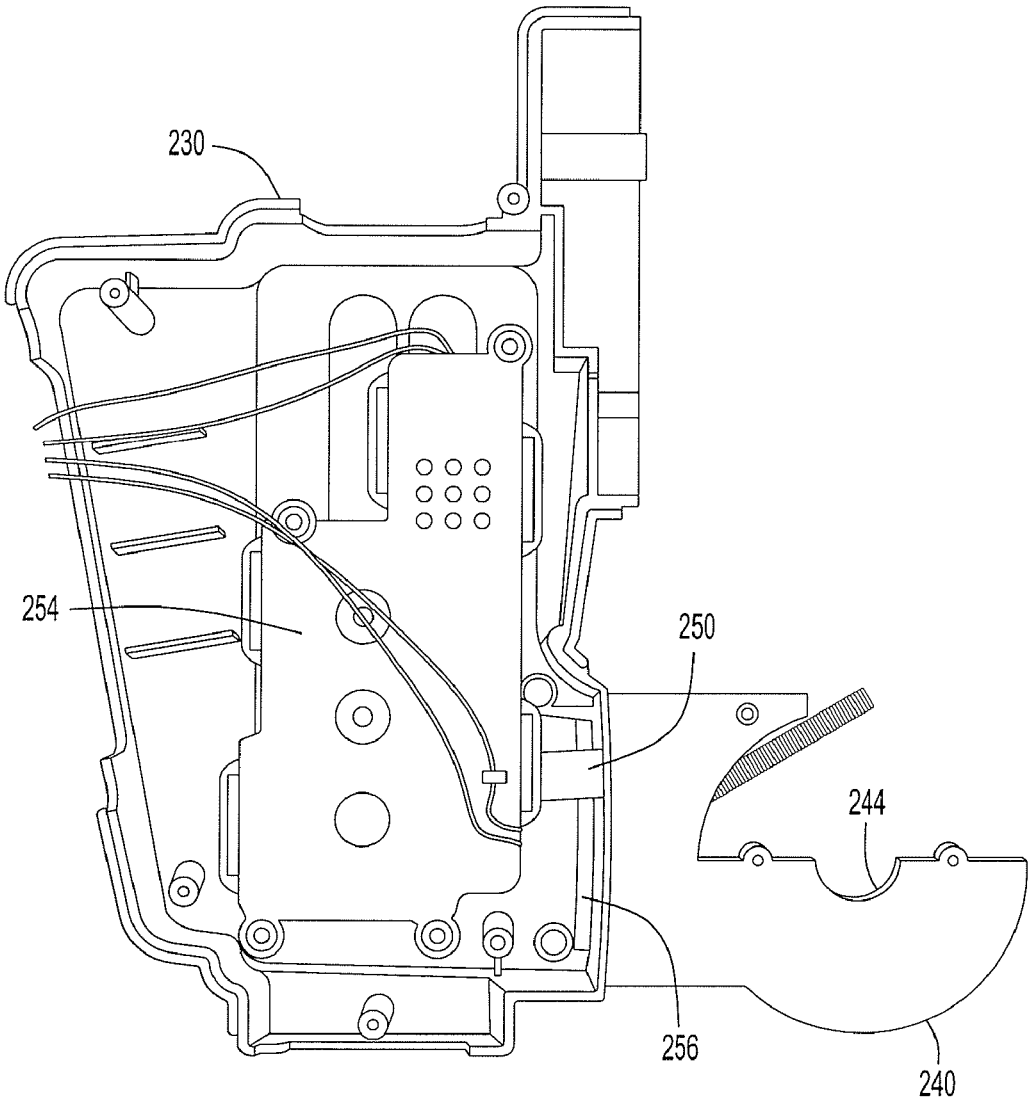
FIG. 5 illustrates an enlarged inner side view of a disassembled base connector of the play implement positioning device of FIG. 1 showing a motorized gearbox.
Figure 6:
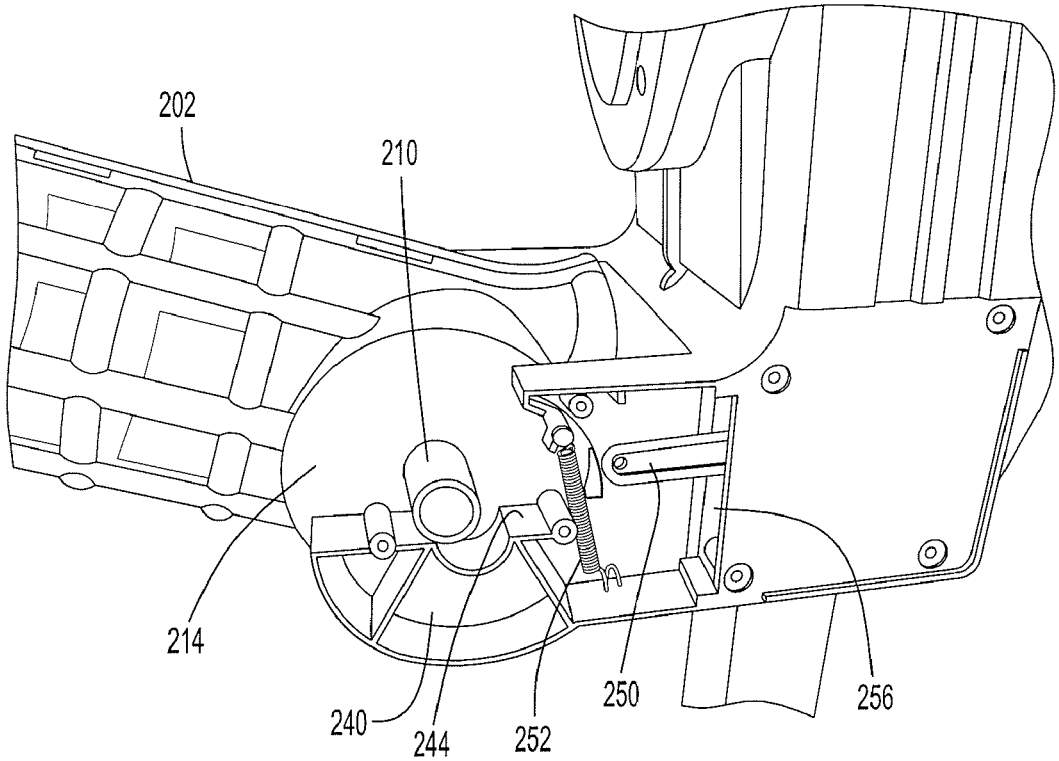
FIG. 6 illustrates a side perspective view of some of the internal components of a loader of the play implement positioning device of FIG. 1.

Referring to FIGS. 4-7, the pivot connection between the base connector 201 and the storage member 202 and the connection between the motorized mechanism and the storage member 202 will now be discussed. FIG. 4 shows a perspective view of a partially disassembled base connector 201 having left and right casings 230, 232 meeting at a casing seam 234. The base connector 201 is disposed on an upper portion of elevation member 300. FIG. 4 also shows left and right lower bearings 240, 242 each respectively having left and right lower bearing surfaces 244, 246. Left and right lower bearing surfaces 244, 246 are arcuate in shaped to coaxially receive left and right axles 210, 212. FIG. 6 shows left axle 210 being received by left lower bearing surface 244.

The toy 10 includes a drive mechanism that includes a gearbox 254 with an internal motor or drive and an arm portion or arm 250 that has a flexible arm portion 252 and a rigid or semi-rigid arm portion 250. FIG. 4 shows a first end of an arm portion 250 extending from an arm access 256 in the left casing 230. The arm portion 250 also has a second end (not shown) that connects to the gearbox 254 shown in FIG. 5. Specifically, FIG. 5 shows the drive mechanism in the form of a motorized gearbox 254 secured to the inside of left casing 230. The rigid arm portion 250 extends from within the motorized gearbox 254 to the inside of the left casing 230 (shown in FIG. 5) and through the arm access 256 to the outside of the left casing 230 as shown in FIG. 4.

Figure 7:
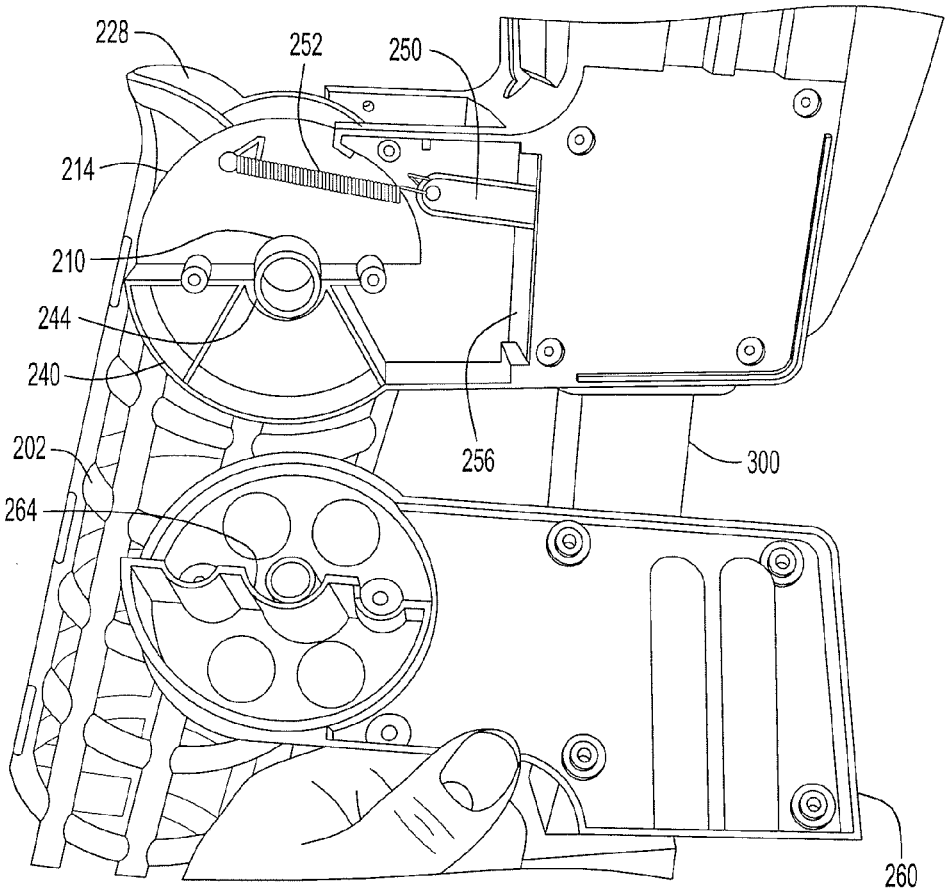
FIG. 7 illustrates a side perspective view of the loader of the play implement positioning device of FIG. 1 exposing a portion of the power transfer mechanism.

FIG. 6 also shows a flexible arm portion 252 in the form of a spring attached at one end to the arm connector 218 (see FIG. 3) and the other end connected to the rigid arm portion 250 (see FIG. 7). FIG. 7 shows the left axle 210 received coaxially in the left lower bearing surface 244. The left and right lower bearings 240, 242, therefore, pivotally support the first end 205 of the storage member 202. Internals components of left and right hinges 203, 204 are revealed by removing left and right casing covers 260, 262 (left casing cover shown in FIG. 7). FIG. 7 also shows the left casing cover 260 having an upper bearing surface 264 which covers the left axle 210. The left axle 210 is therefore secured between the left lower and left upper bearing surfaces 240, 264. Similarly, the right axle 212 is secured between the right lower and right upper bearing surfaces 242, 266. The storage member 202 can now be securely pivoted between the non-load position of FIG. 1 and the load position of FIG. 2.

To pivot the storage member 202 automatically, force must be transferred from the motorized gearbox 254 to the storage member 202. As discussed briefly above, the rigid arm portion 250 has a first end extending into the motorized gearbox 254 and a second end that extends out of the motorized gearbox 254. The motorized gearbox 254 imparts a reciprocating motion to the rigid arm portion 250 along the length of the rigid arm portion 250.

FIG. 7 shows how the second end of the rigid arm portion 250 is connected to an end of the flexible arm portion 252. As discussed above, the opposite end of the flexible arm portion 252 is connected to the arm connector 218 disposed on the left plate 214. With the left and right axles 210, 212 secured between corresponding bearing surfaces 240, 242, 264, 266, the storage member 202 can be pivoted about axis 213 through the left and right axles 210, 212. Specifically, pivoting of the storage member 202 is achieved by applying a force from the drive mechanism to the arm connector 218. Therefore, when the motor (not shown) is energized, the motorized gearbox 254 pulls the second end of the rigid arm portion 250 toward the motorized gearbox 254 into the arm access 256. In turn, the second end of the rigid arm portion 250, which is connected to the flexible arm portion 252, also pulls the first end of the flexible arm portion 252 toward the motorized gearbox 254. Finally, the second end of the flexible arm portion 252, being connected to the arm connector 218, applies a force to the arm connector 218 to pivot the lower end 206 of the storage member 202 about the pivot axis 213. After a play implement 800 is placed onto the implement support 500, the storage member 202 pivots back to the non-load position of FIG. 1. The storage member 202 is attached to the rigid arm portion 250 which is at its return position relative to the gearbox. The flexible arm portion 250 (spring) prevents the drive mechanism from being damaged if an external force is imparted from the storage member 202 back to the drive mechanism. For example, if a child grabs or bumps the storage member 202 during operation, the flexible arm portion 252 flexes to absorb any harmful or excessive load that would normally be transferred to the drive mechanism.

Figure 8:
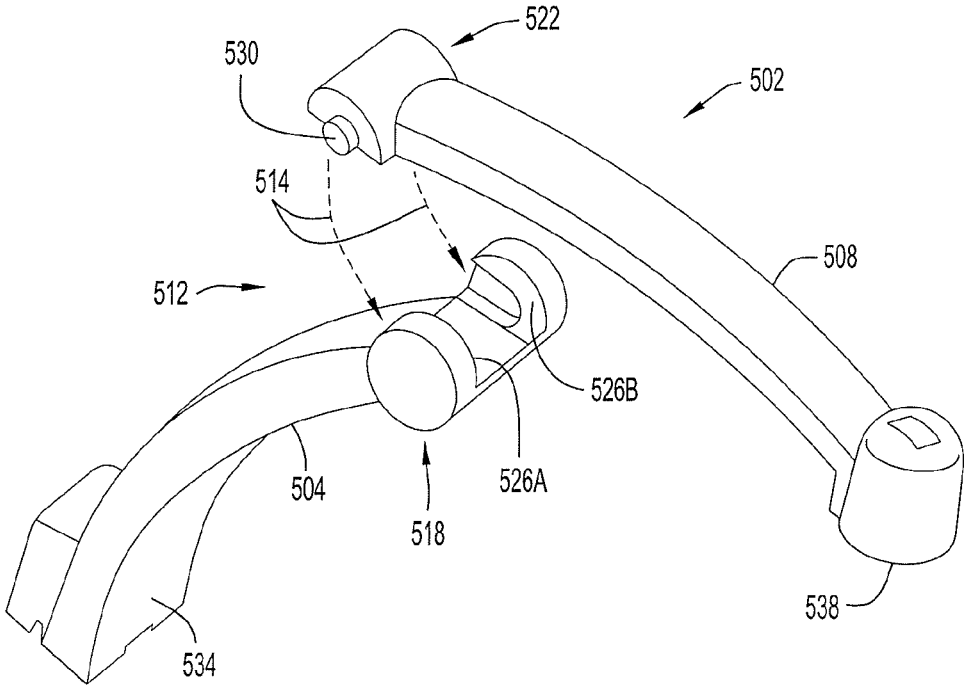
FIG. 8 illustrates an exploded view of a suspension arm of the play implement positioning device of FIG. 1.
Figure 9:
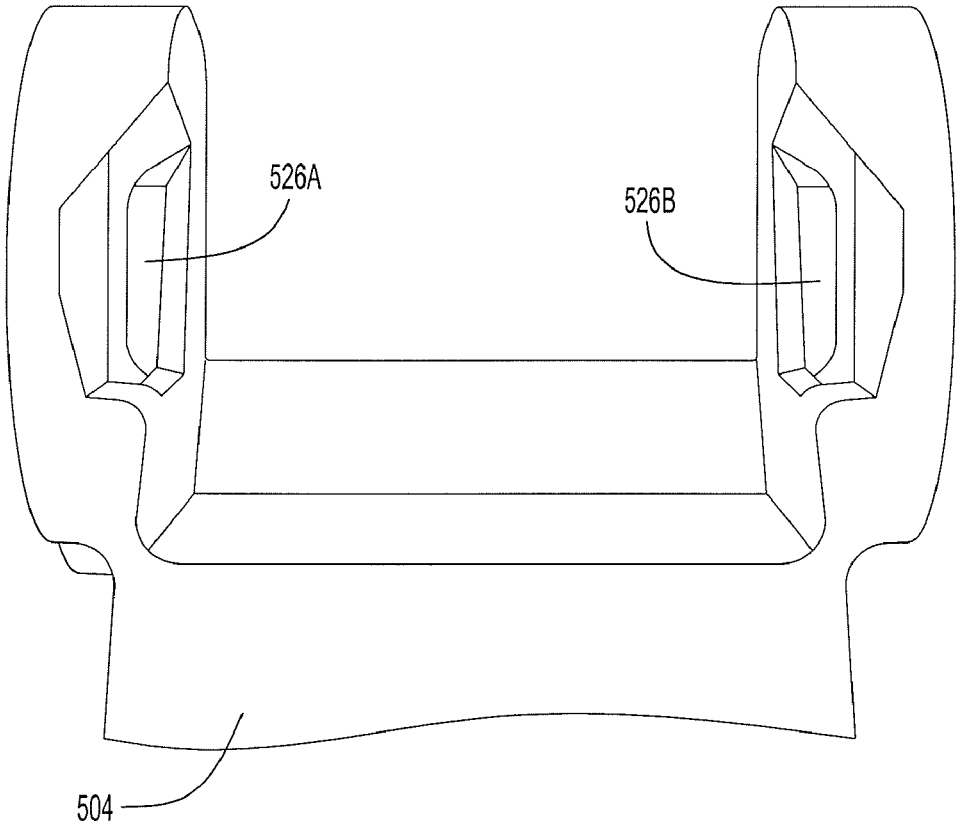
FIG. 9 illustrates an enlarged view of an arm receiver of the suspension arm of FIG. 8.

FIG. 8 shows an exploded view of suspension arm 502 of the implement support 500. Suspension arm 502 includes an inner arm 504 and an outer arm 508. The inner arm 504 includes a first end having base receiver 534 which facilitates connection of the suspension arm 502 to the elevation member 300 of the play implement positioning device 100. The outer arm 508 includes a second end having a flexible member receiver 538 from which a flexible member (discussed below) is suspended. The second end of the inner arm 504 includes an arm receiver 518 and the first end of the outer arm 508 includes a pivot end 522. The arm receiver 518 and the pivot end 522 connect to form a hinge 512. The pivot end 522 of the outer arm 508 includes projections 530 and the arm receiver 518 of the inner arm 504 includes projection receivers 526 for pivotally receiving the projections 530 of the pivot end 522. The projections 530 and projection receivers 526 of hinge 512 are connected in the manner indicated by direction arrows 514. Hinge 512 allows the outer arm 508 to pivot upwardly relative to the inner arm 504 for easy storage. Furthermore, during loading, when a stored implement 800 makes contact with the suspension arm 502 via the flexible or elongate member 552, hinge 512 limits the connection force by allowing the outer arm 508 to pivot upwardly. FIG. 9 shows a close-up view of the first and second projection receivers 526A, 526B of the inner arm 504.

Figure 10:
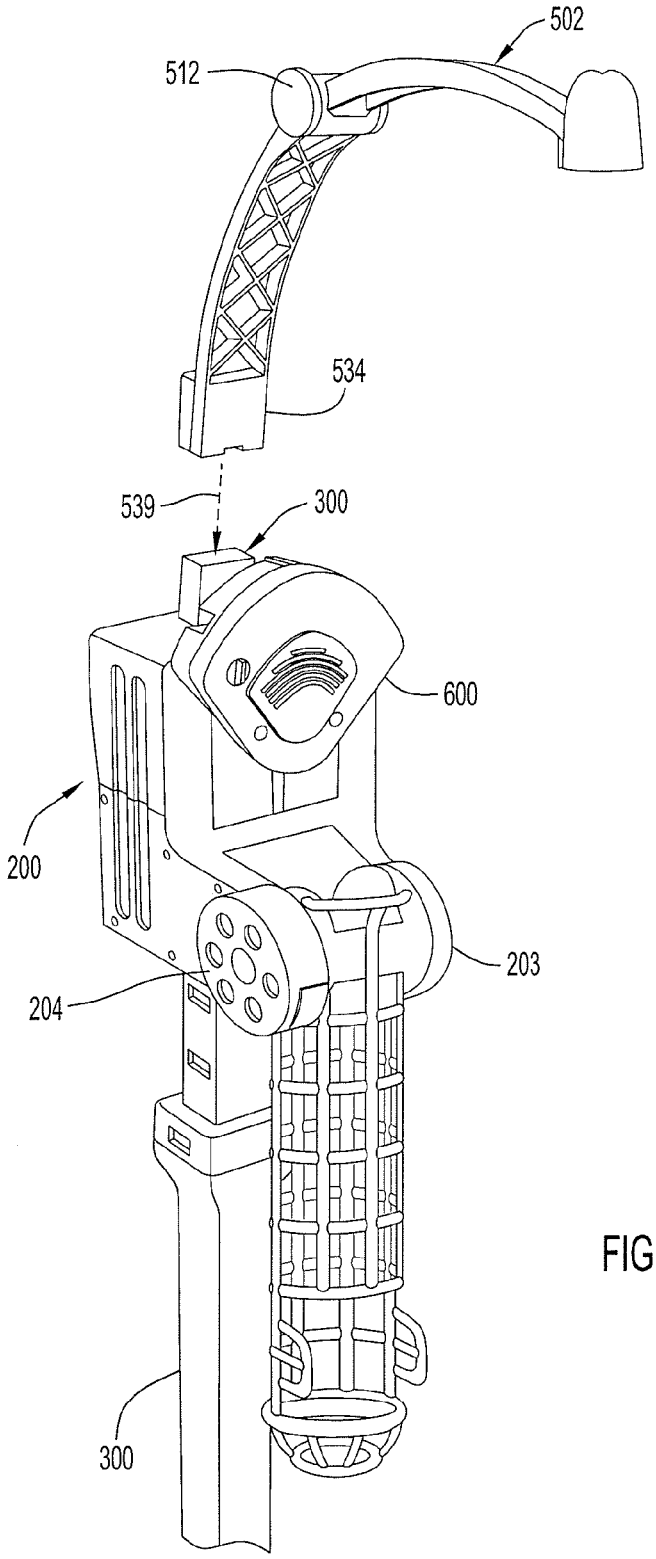
FIG. 10 illustrates the assembly of the suspension arm onto an elevation member of the play implement positioning device of FIG. 1.
Figure 11A:
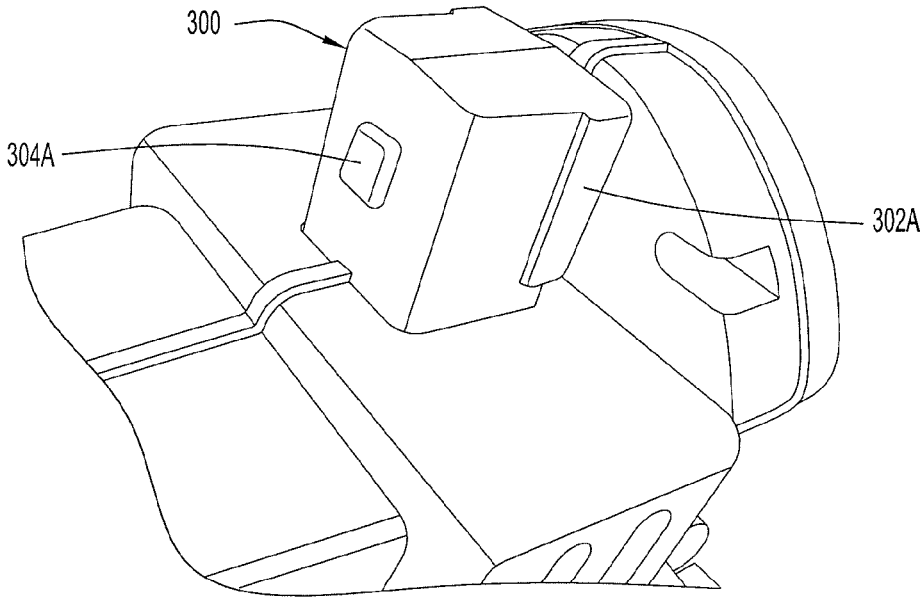
FIGS. 11A and 11B illustrate close-up perspective views of connection features on an upper portion of the upper post of the play implement positioning device.
Figure 11B:
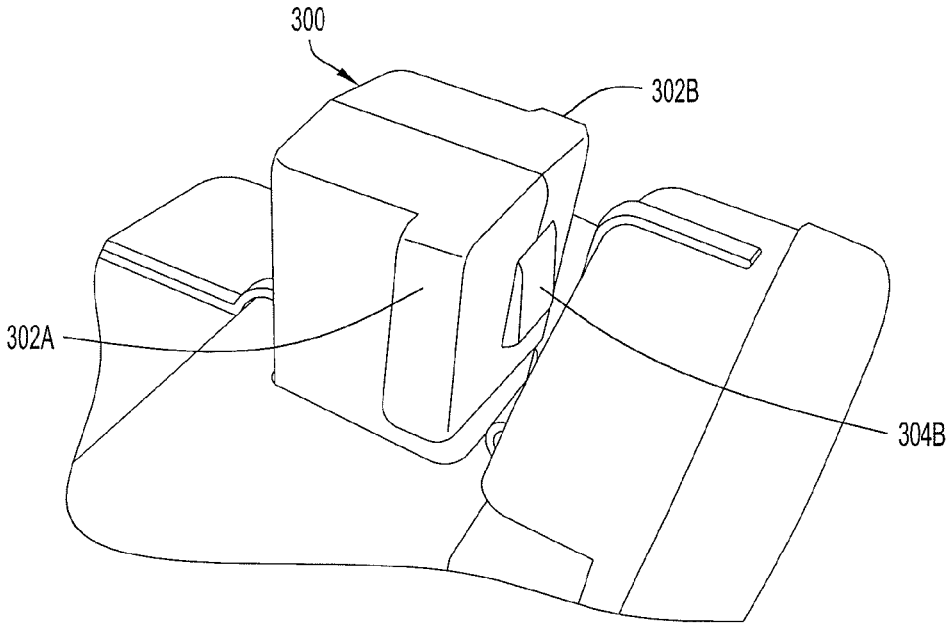
Figure 12:
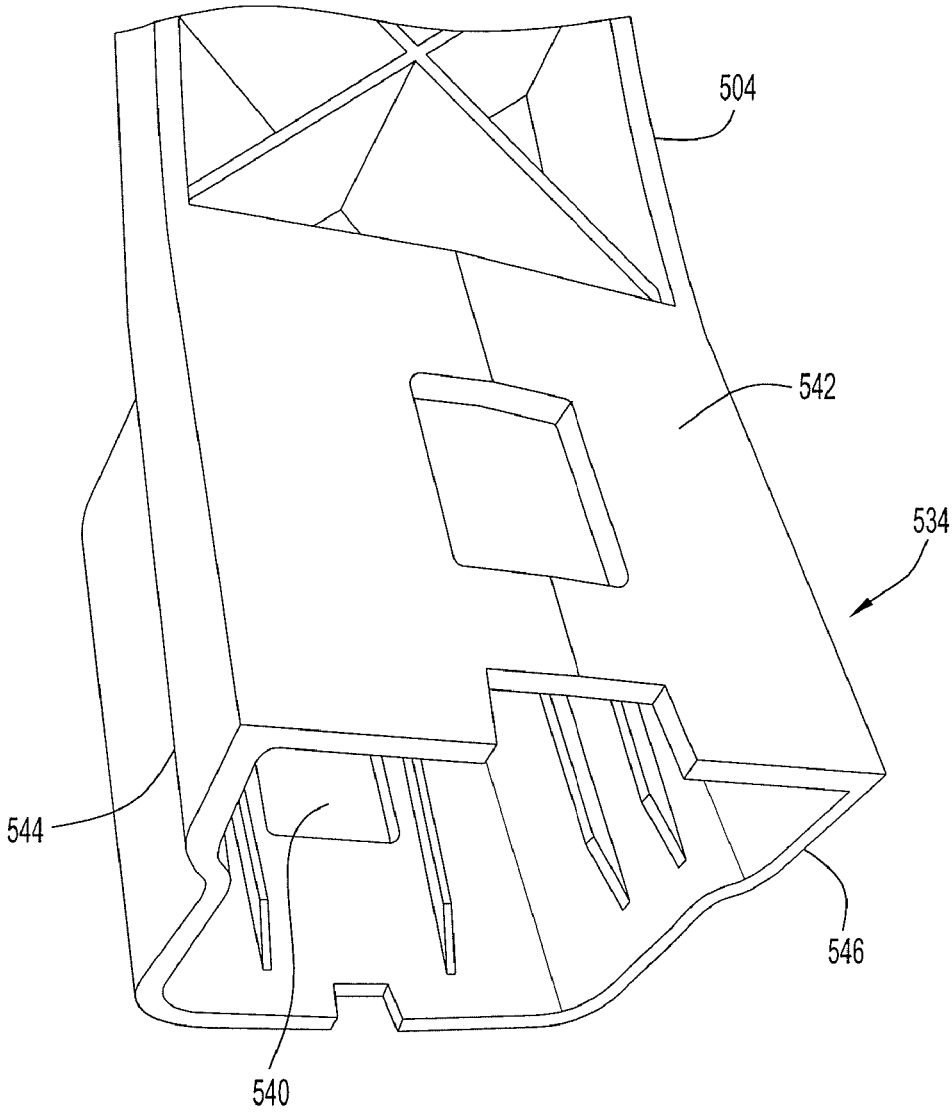
FIG. 12 illustrates a close-up view of the base receiver of FIG. 10.

FIGS. 10-12 show how the suspension arm 502 is connected to the elevation member 300 of the play implement positioning device 100. The base receiver 534 of the suspension arm 502 is placed over the upper portion of the elevation member 300 and fastened thereto by connectors. Specifically, the connection direction is shown by arrow 539 that indicates the direction in which base receiver 534 is connected to elevation member 300. FIGS. 11A and 11B show a top portion of elevation member 300 including post guides 302A and 302B and securing bosses 304A, 304B. Referring to FIG. 12, base receiver 534 includes receiver guides 544, 546 and boss receivers 540, 542. The base receiver 534 is made from a flexible material, such as molded plastic, and is forced onto the elevation member 300 such that the receiver guides 544, 546 slide over the post guides 302A, 302B. In addition, the boss receivers 540, 542 are respectively forced over securing bosses 304A, 304B. Boss receivers 540, 542 receive securing bosses 304A, 304B to resist removal of the base receiver 534 from the elevation member 300 to secure the suspension arm 502 to the elevation member 300.

Figure 13:
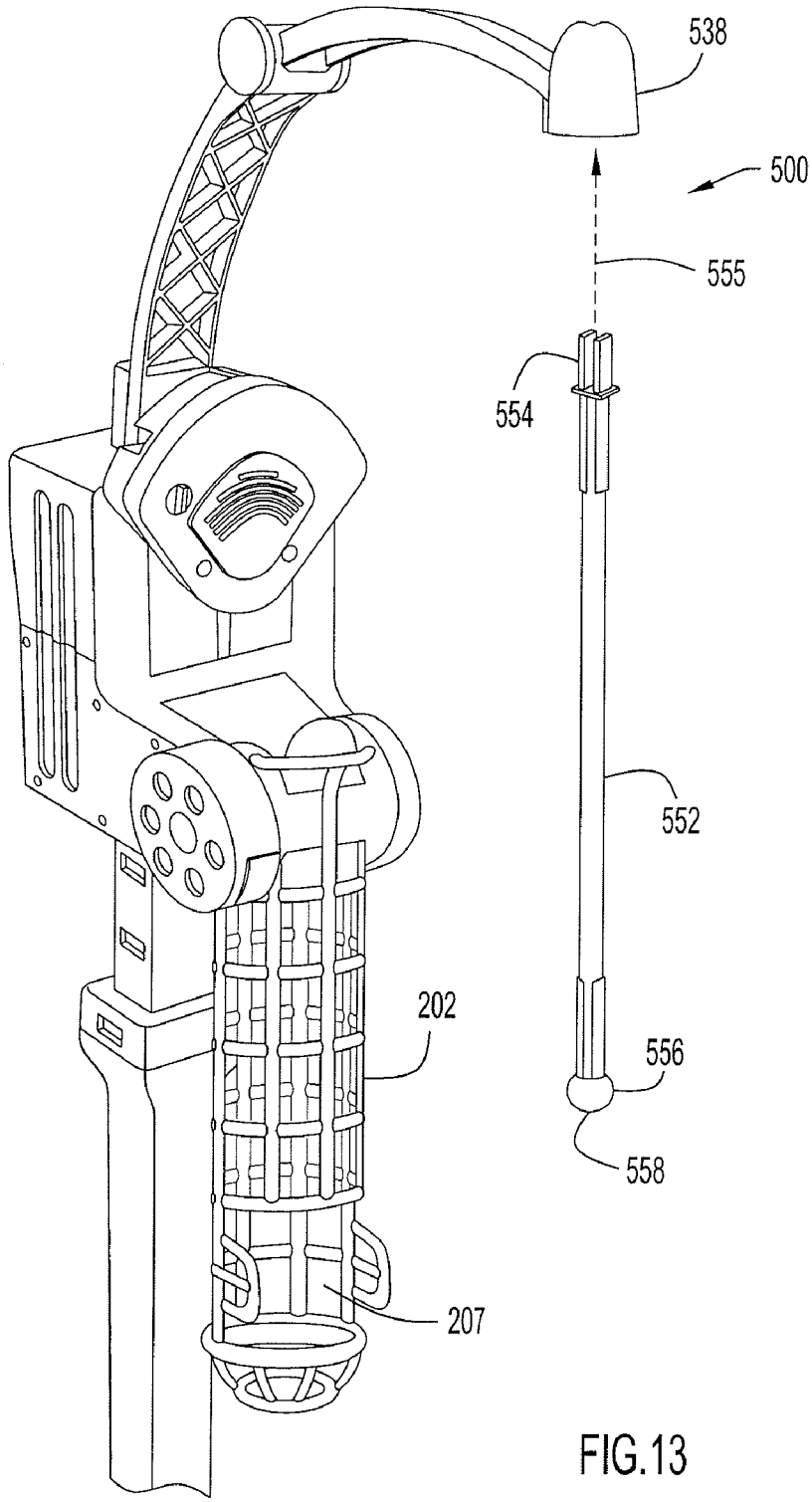
FIG. 13 illustrates the assembly of a flexible member onto the suspension arm of the play implement positioning device of FIG. 1.
Figure 14:
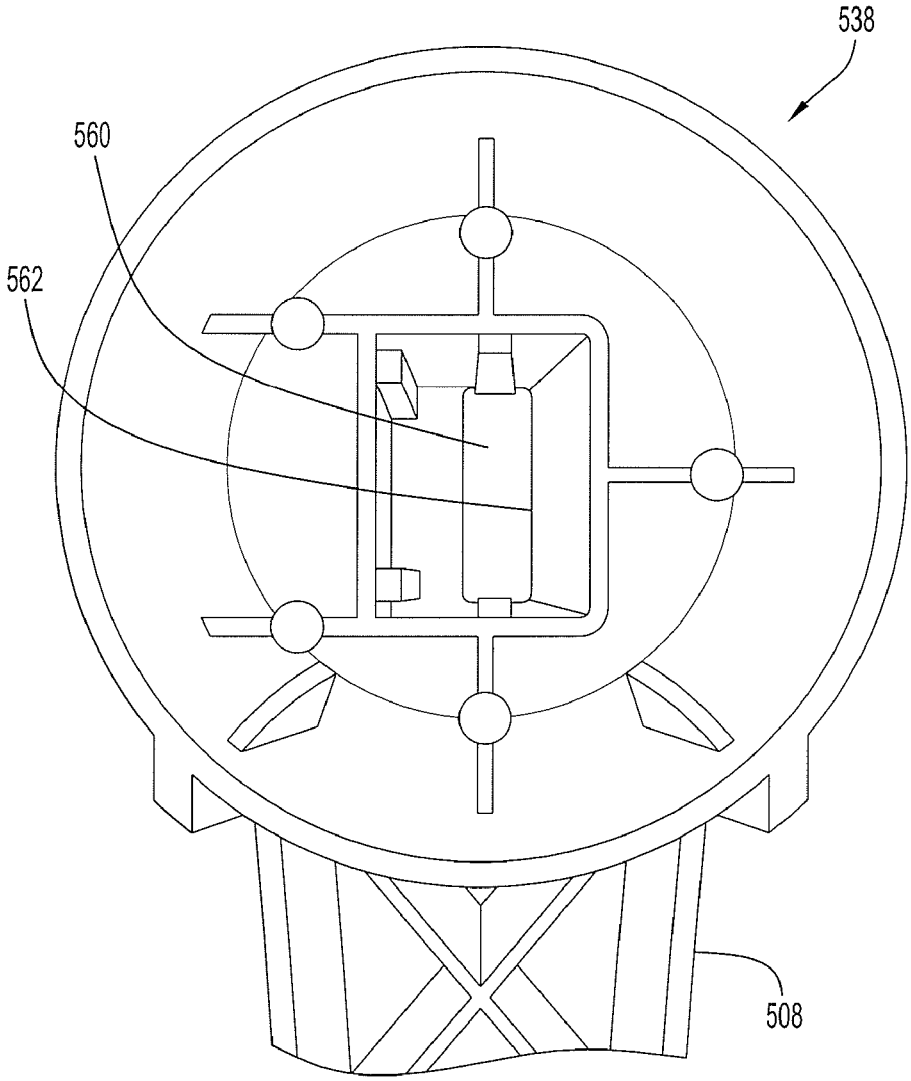
FIG. 14 illustrates a close-up view of the flexible member receiver of the play implement positioning device of FIG. 13.
Figure 15:
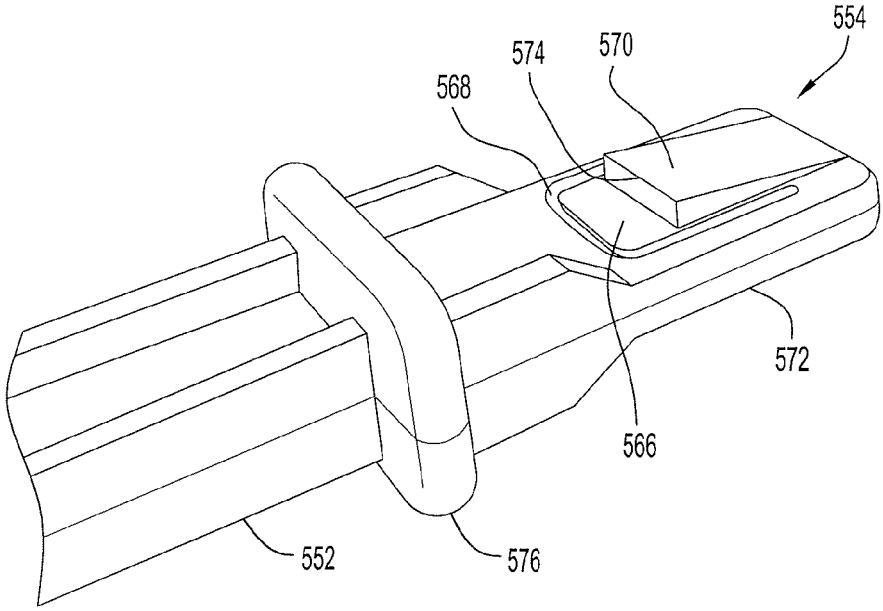
FIG. 15 illustrates a close-up view of the flexible member connector of the play implement positioning device of FIG. 13.

FIGS. 13-15 illustrate the connection between a flexible or elongate member 552 of the implement support 500 and the flexible member receiver 538 which extends from the end of the outer arm 508. The flexible or elongate member 552 and the support 500 form a ball holding device for the system. FIG. 14 shows an enlarged lower side of the flexible member receiver 538 including receiving edges 562 defining a receiving slot 560. The flexible member 552 includes an upper end and a lower end and a flexible member connector 554 (see FIG. 13). As shown in FIG. 15, the flexible member connector 554 includes a tab 566 defined by a slot 568 having a U-shape. The tab 566 includes a wedge 570 having a wedge surface 572 and a ledge 574. The flexible member connector 554 also includes a stop 576. The flexible member 552 is connected to the suspension arm 502 by inserting the flexible member connector 554 into the flexible member receiver 538 as shown by connection direction arrow 555 in FIG. 13. Specifically, when the tab 566 is inserted into the receiving slot 560, the wedge surface 572 contacts at least one of the receiving edges 562 to flex the tab 566 inwardly. When the tab 566 has been inserted completely into the receiving slot 560, the tab 566 flexes back into its original position such that the ledge 574 contacts the receiving edge 562 to prevent removal of the flexible member connector 554 from the receiving slot 560. In addition, stop 576 prevents the flexible member connector 554 from being inserted too far into the receiving slot 560 of the flexible member receiver 536.

Referring to FIG. 13, the flexible member 552 also includes a first implement connector or connection mechanism 556 attached to the end of the flexible member 552 opposite the flexible member connector 554. The first implement connector or connection mechanism 556 is formed in a shape that best facilitates connection to the play implement 800. For example, the first implement connector 556 can be rounded or formed as a sphere or hemisphere. In other embodiments, any shape can be used. Furthermore, a gripper 558 is attached to the end of the first implement connector 556. The gripper 558 resists separation of the first implement connector 556 from the play implement 800 after the storage member 202 places them in contact with each other. For example, the gripper 558 could be a hook material that is attached to the first implement connector 556 that connects to a loop material of the play implement 800. In other implementations, the gripper could also use magnetic attraction, suction or any other mechanical or electromechanical means of resisting separation between the first implement connector 556 and the play implement 800.

Figure 16:
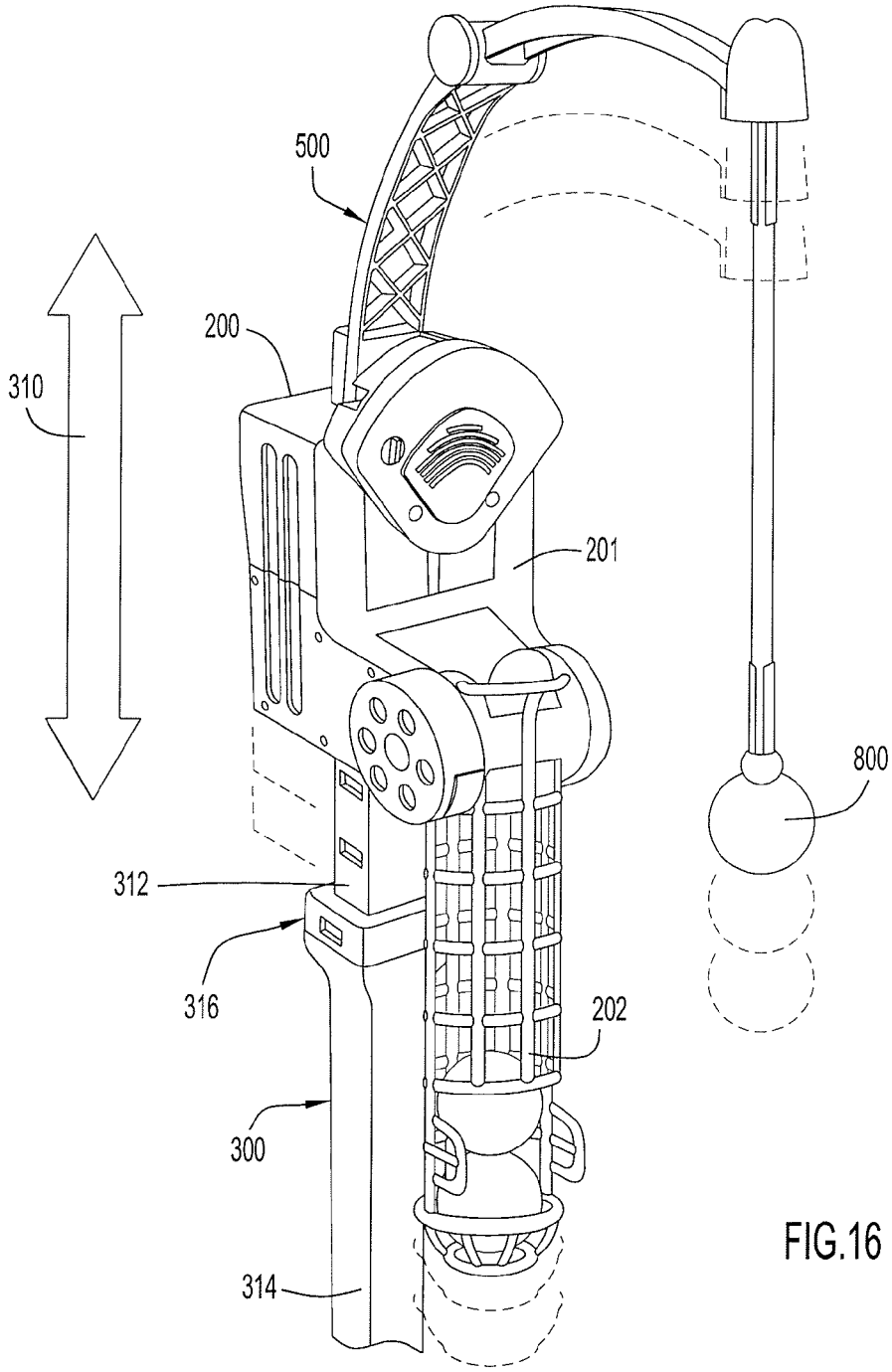
FIG. 16 illustrates a height adjustment feature of the play implement positioning device of FIG. 1.
Figure 17:
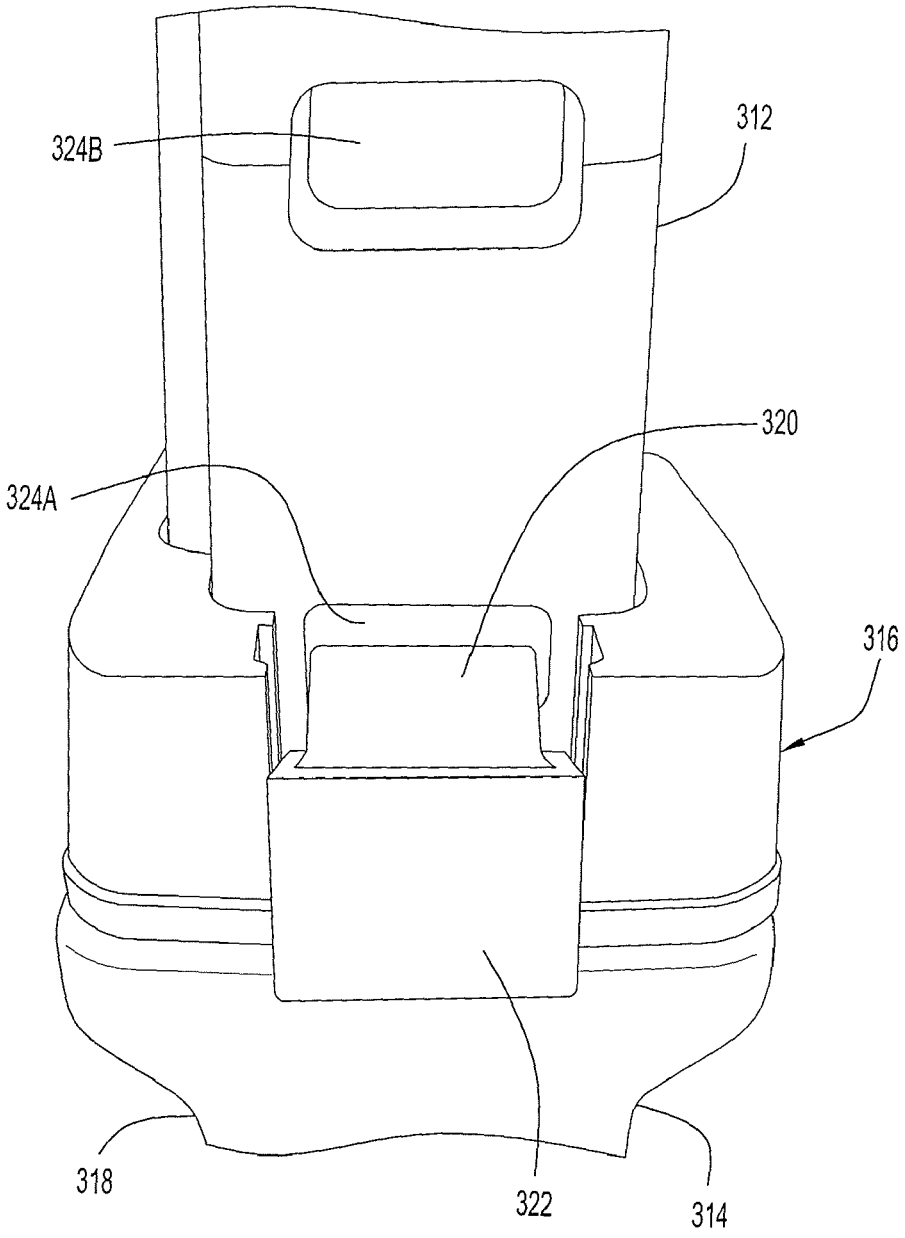
FIG. 17 illustrates a close-up view of the slide lock of the play implement positioning device of FIG. 16.
Figure 18:
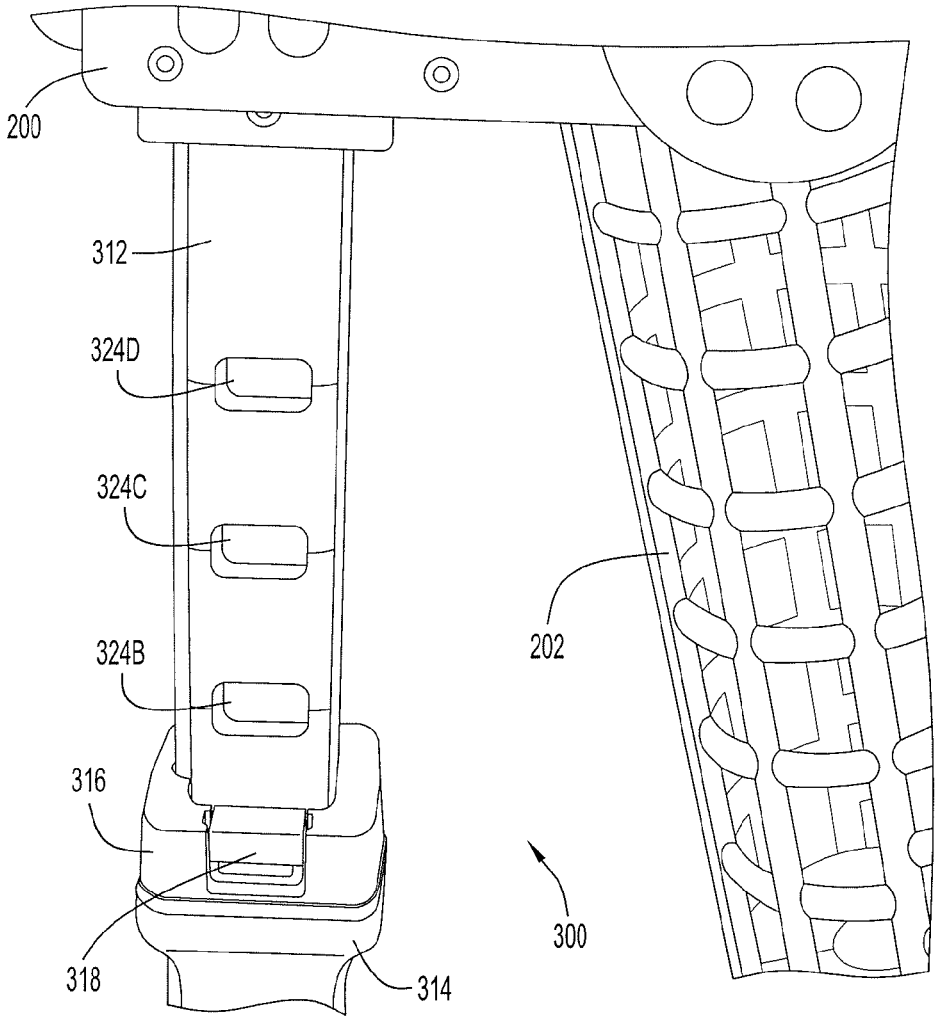
FIG. 18 illustrates a side view of the slide lock locking an extended elevation member of play implement positioning device of FIG. 16.

FIGS. 16-18 illustrate the height adjustment mechanism of the play implement positioning device 100. The height adjustment mechanism enables a user to adjust the height of the play implement (relative to a support surface 10) when the play implement positioning device 100 suspends the play implement 800 in the play position 820. The elevation member 300 includes an upper post 312 that telescopes within a lower post 314 along the direction of arrow 310. As shown in FIG. 16, the loader or ball loading device 200, which includes the base connector 201 and the storage member 202, is fixed to the upper post 312. When the upper post 312 is moved relative to the lower post 314, the height of the loader 200 is adjusted relative the lower post 314. Furthermore, the implement support 500 is fixed to the upper post 312. Therefore, when the upper post 312 is raised relative the lower post 314, the loader 200, the implement support 500, and therefore, the play position 820, are simultaneously raised relative to the support surface 10. In other words, as the upper post 312 is raised, the storage member 202 and flexible member 552 do not move relative to each other. As a consequence, the second end 206 of the storage member 202 always pivots in a path that intersects the first implement connector 556 for loading another play implement 800 into the play position 820.

As shown in FIG. 17, the upper post 312 also slides within a slide lock 316 that is attached to the lower post 314. The slide lock 316 locks the upper post 312 and lower post 314 relative to each other. The slide lock 316 includes a latch 318 that is pivotally secured to the slide lock 316. The latch 318 includes a handle 322 for pivotally manipulating the latch 318. The latch 318 also includes a protrusion 320 that pivots toward and away from the upper post 312 as the latch 318 is pivoted. The upper post 312 includes post openings 324A-D (see FIG. 18—opening 324A not shown because it is engaged by latch 318) that are spaced along the length of the upper post 312 and which are in alignment with the latch 318. The openings 324A-D are configured to receive the protrusion 320 of the latch 318 when the upper post 312 is moved to different positions relative to the lower post 314 and the slide lock 316. FIG. 17 shows the latch 318 in an unlocked position.

The slide lock 316 is locked by manipulating the handle 322 upward from the position illustrated in FIG. 17 to move the protrusion 320 toward the upper post 312 and into a post opening 324A as shown in FIG. 18. FIG. 18 shows the elevation member 300 locked in its most extended position (the highest play implement play position) with the protrusion 320 secured in post opening 324A. Locking the slide lock 316 in any of the post openings 324B-324D will result in a respective lowering of the implement support 500, and therefore, a lowering of the play position 820 as shown in FIG. 16.

Figure 19:
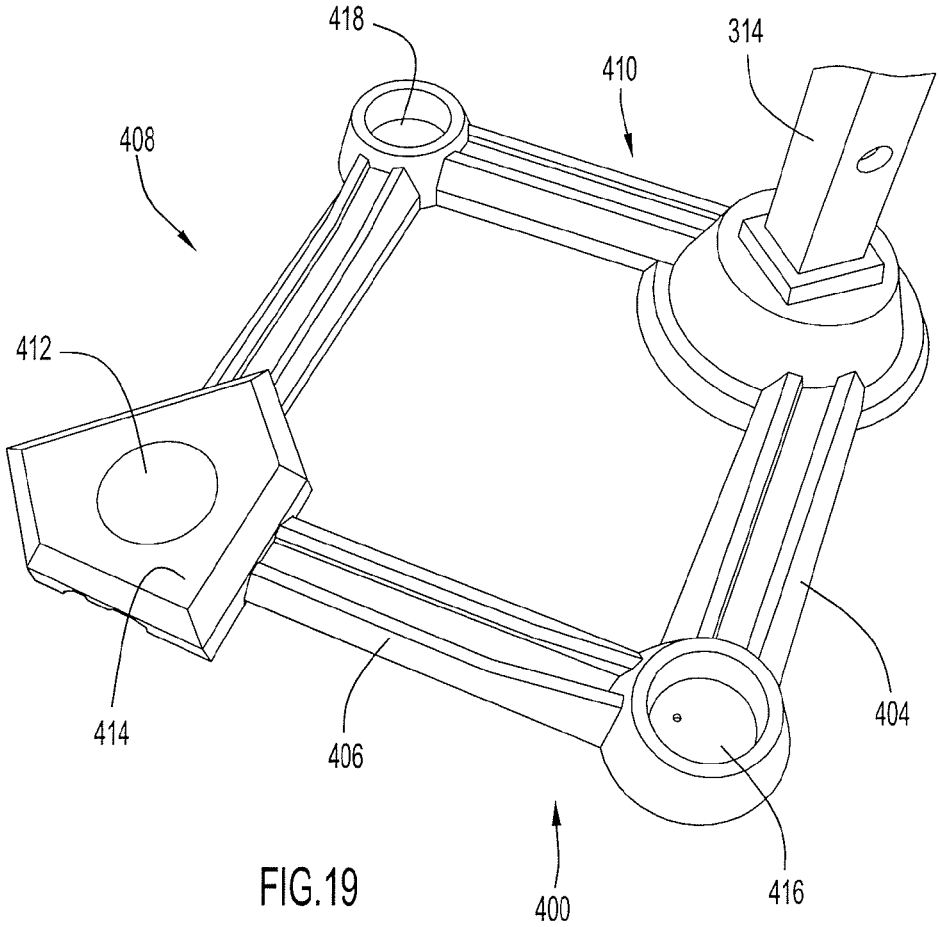
FIG. 19 illustrates a close-up view of the support surface engagement member of the play implement positioning device of FIG. 1.
Figure 20:
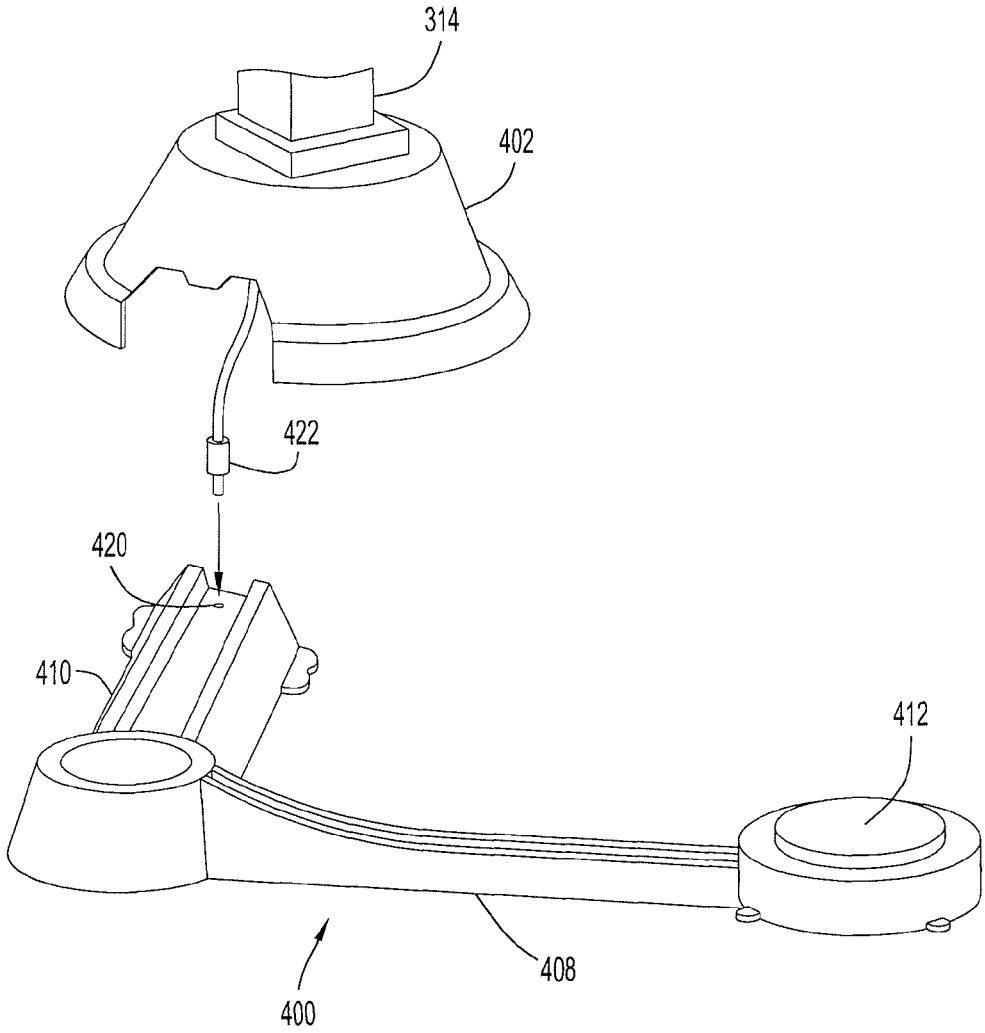
FIG. 20 illustrates a plug and plug receptacle of the actuation system of the play implement positioning device of FIG. 1.
Figure 21:
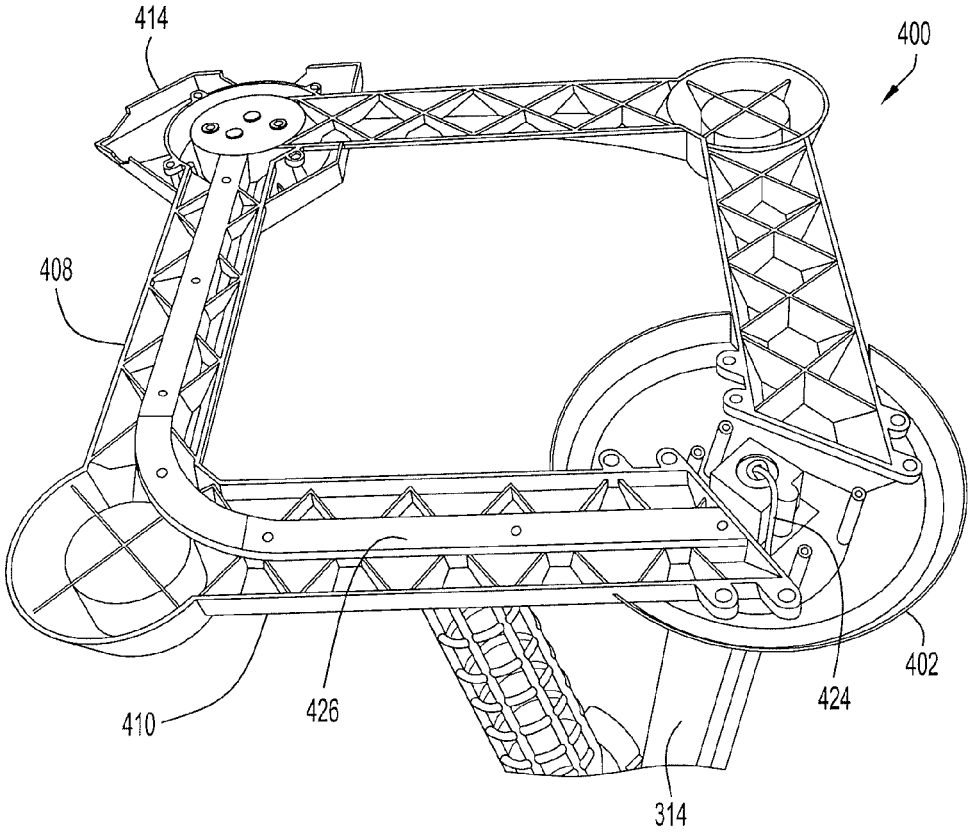
FIG. 21 illustrates a bottom view of the support surface engagement member of FIG. 1 showing a path of the electric wire.

FIGS. 19-21 illustrate the load actuation features of the play implement positioning device 100 used by the child 900 to automatically load a play implement 800 into the play position. FIG. 19 illustrates the support surface engagement member 400 including a post receptacle 402 that receives the lower post 314. The support surface engagement member 400 further includes first, second, third and fourth legs 404, 406, 408 and 410. A bat receptacle 416 is located between legs 404, 406 and another bat receptacle 418 is located between legs 408, 410. Button cover 414 is placed over actuator 412 which is located between the second and third legs 406, 408. When the child 900 strikes a play implement 800 held in the play position 820 by the play implement positioning device 100, the child 900 signals the play implement positioning device 100 to load another play implement 800 by pressing actuator 412 (For example, by stepping on the button). Actuator 412 is electrically connected to the electronic controller 600 by electric wire 424. Furthermore, along the length of legs 408, 410 the wire 424 is enclosed in a conduit or cover 426.

Figure 22:
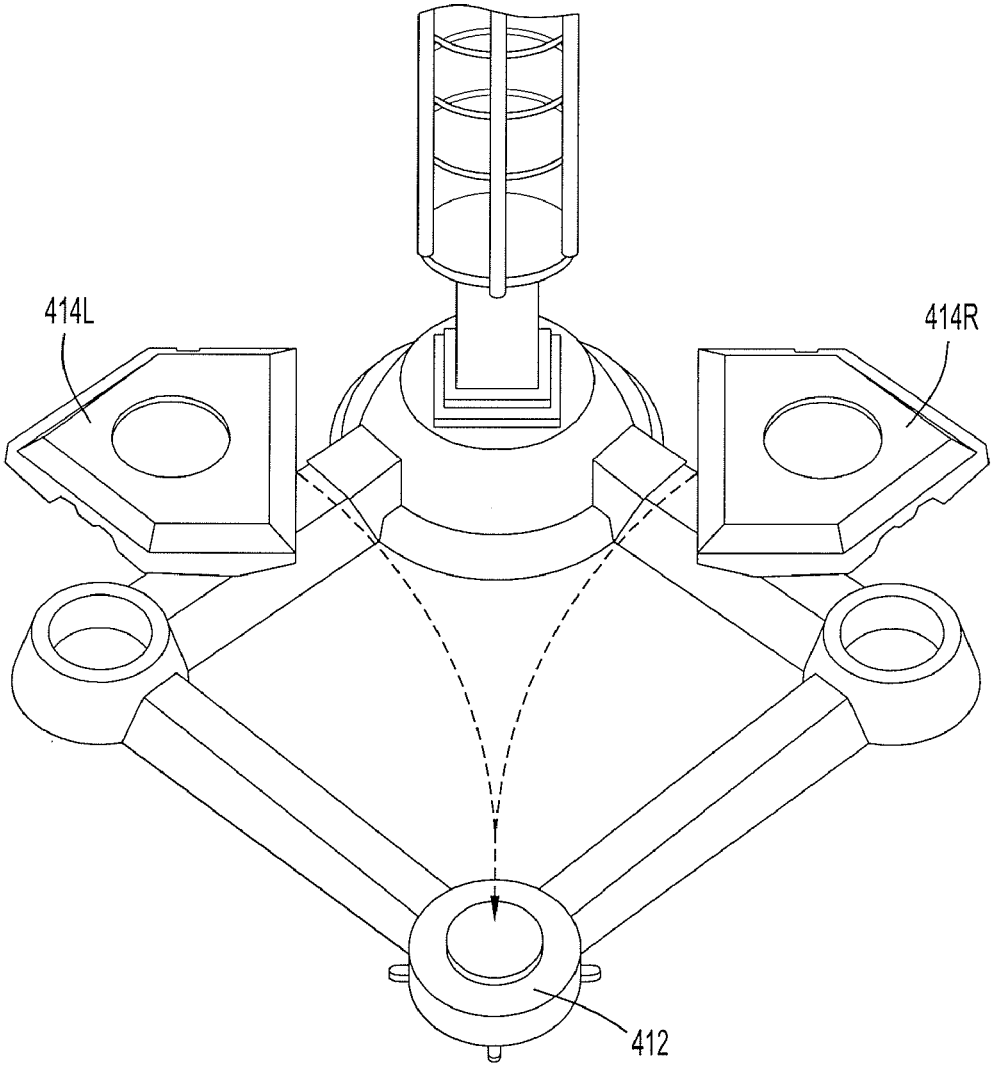
FIG. 22 illustrates a support surface engagement member having button cover configuration for a left or a right handed batter.

FIG. 20 shows wire 424 emerging from the lower end of lower post 314 and passing to plug receptacle 420. The electrical wire runs from the actuator 412 down the second leg 406 then down the third leg 408 to a plug receptacle 420 mounted on the upper side of the end of third leg 408. Electrical wire also runs from the loader 200 down through the upper and lower posts 312, 314 to a plug 422. Electrical communication between the actuator 412 and the electronic controller 600 in the loader 200 is complete when the plug 422 is received in the plug receptacle 420. The separable plug allows the electrical wiring to be disconnected so that the lower post 314 can be completely disconnected from the surface engaging support member 400. Moreover, FIG. 22 shows how button cover 414 can be arranged on the actuator 412 in a button cover left 414L position or button cover right 414R position for a left handed batter or a right handed batter respectively.

Figure 23:
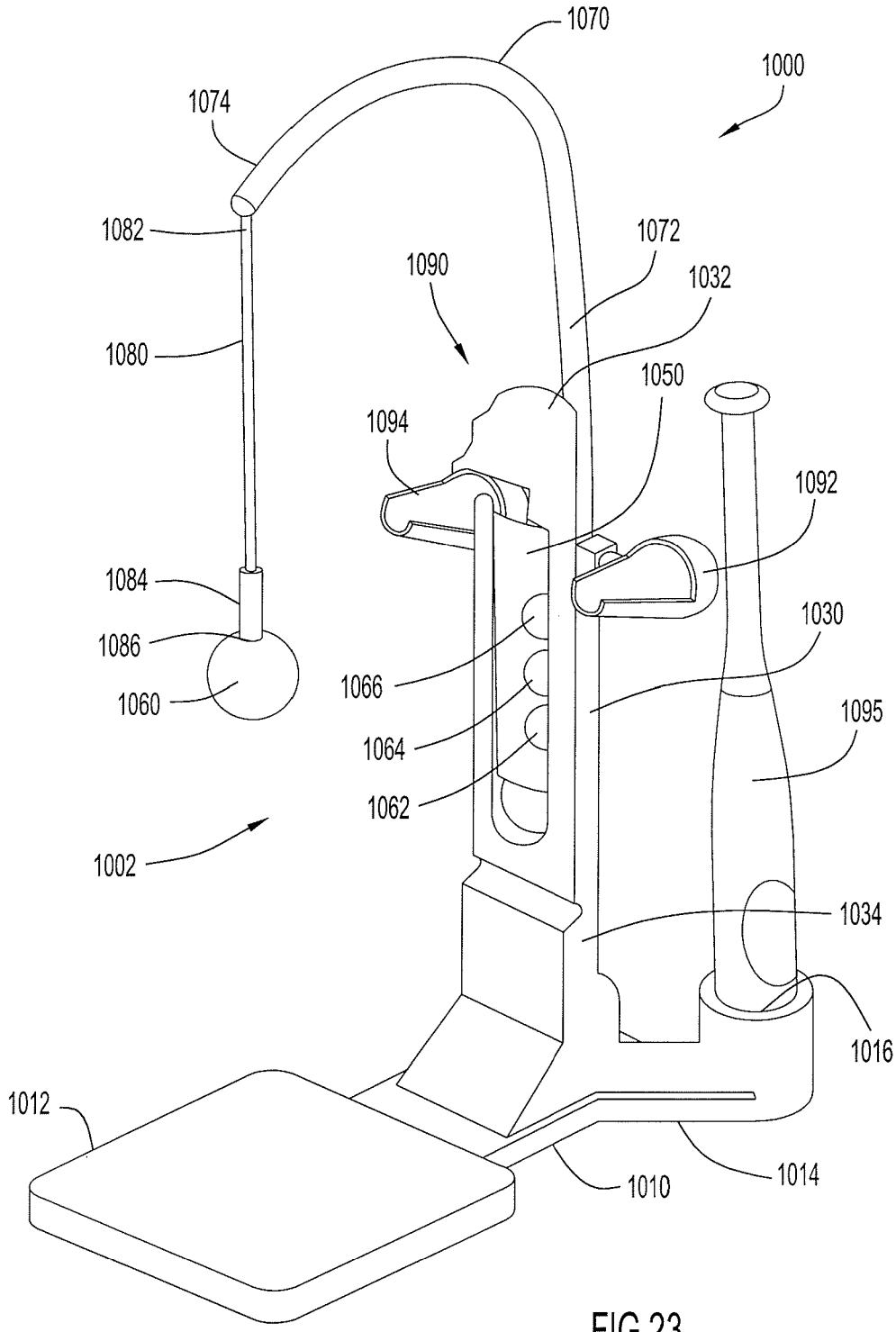
FIG. 23 illustrates an alternative embodiment of a play implement positioning device according to the present invention in a non-load configuration.
Figure 24:
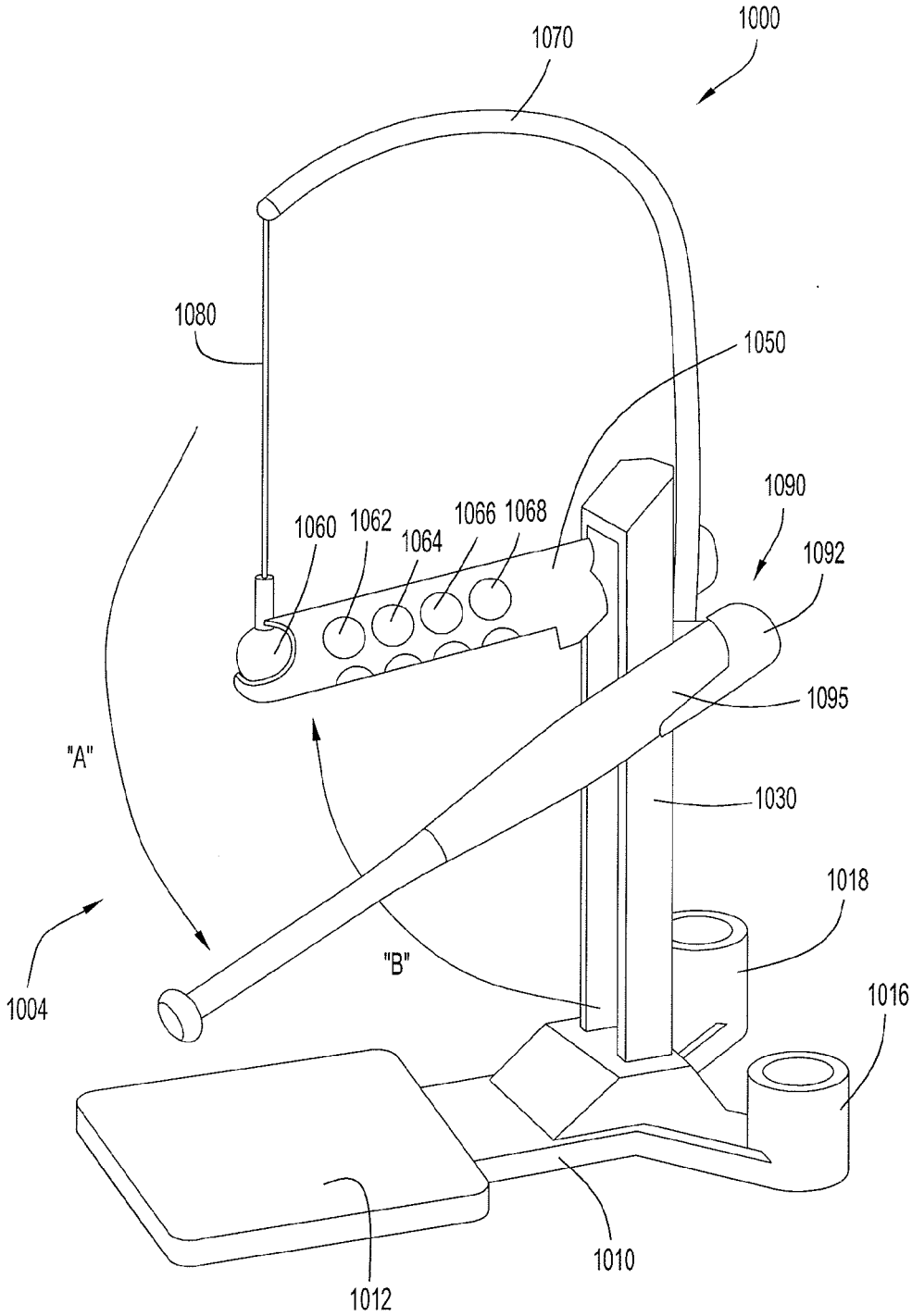
FIG. 24 illustrates the play implement positioning device of FIG. 23 in a load configuration.

An alternative embodiment of a play implement positioning device is illustrated in FIGS. 23 and 24. As illustrated, play implement positioning device 1000 includes a base 1010, a support 1030 and a support or support member 1070. The base 1010 includes a plate 1012 and an arm portion 1014 that has a receptacle 1016 formed therein into which an end of a bat 1095 can be inserted. The base 1010 also includes another receptacle 1018 on the other side of the support 1030. The support 1030 has an upper end 1032 and a lower end 1034. The support member or support arm 1070 has ends 1072 and 1074 and is coupled to the support 1030. A flexible member 1080 is coupled to the support member 1070 proximate to end 1074. The flexible member 1080 has an upper end 1082 and a lower end 1084 to which a connector or gripper 1086 is coupled.

The positioning device 1000 includes a loader 1050 with an opening 1058 near one end through which a play implement 1060 such as a ball can be removed. The loader 1050 is configured so that it can retain additional play implements 1062, 1064, 1066, and 1068. The positioning device 1000 has a non-load configuration 1002 (see FIG. 23) and a load configuration 1004 (see FIG. 24). The loader 1050 is movable between a non-load position in configuration 1002 and a load position in configuration 1004. As shown in FIG. 23, a play implement 1060 is releaseably coupled to the gripper 1086.

Referring to FIG. 23, the positioning device 1000 includes an actuator 1090 that is manually actuated to move the loader 1050 between its load position and its non-load position. The actuator 1090 includes two receptacles 1092 and 1094, each of which is disposed on an opposite side of the support 1030. As a result, left-handed batters and right-handed batters can insert the bat 1095 into one of the receptacles 1092 and 1094, depending on which side of the plate 1012 the batter is standing. The bat 1095 can be used as a lever by the batter. As the batter moves the bat 1095 downwardly along the direction of arrow "A," a coupling mechanism, such as a cam or linkage mechanism, causes the loader 1050 to move upwardly along the direction of arrow "B." The batter can determine the speed at which the loader 1050 is moved to reload a play implement 1060 by controlling how quickly the batter moves the bat 1095.

Figure 25:
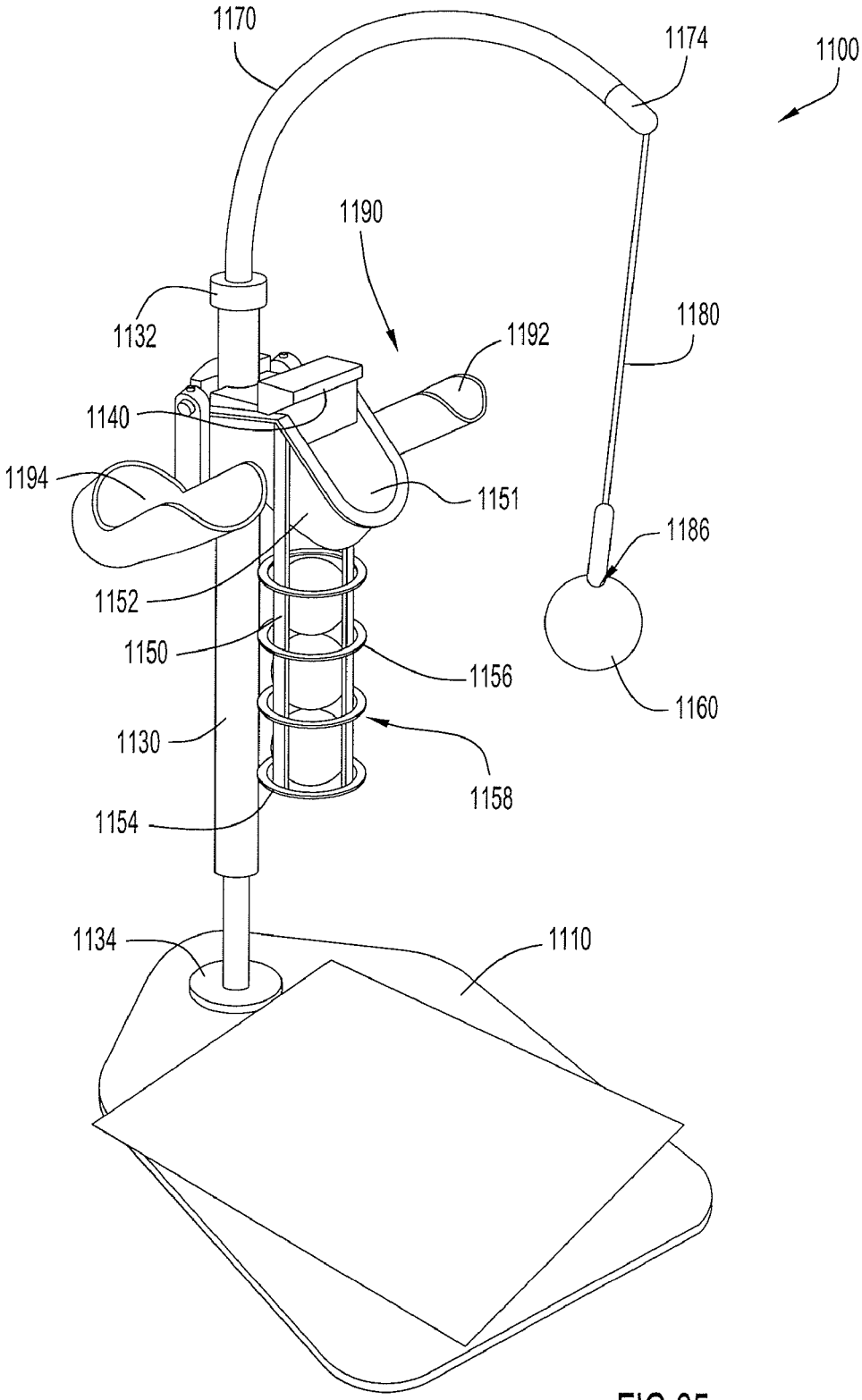
FIG. 25 illustrates an alternative embodiment of a play implement positioning device according to the present invention in a non-load configuration.

An alternative embodiment of a play implement positioning device is illustrated in FIG. 25. In this embodiment, the positioning device 1100 includes a base 1110, a support 1130 with an upper end 1132 and a lower end 1134, and a support member 1170 coupled to the upper end 1134 of the support 1130. The support member 1170 includes an end 1174 to which a flexible member 1180 is connected. The flexible member 1180 includes a connector or gripper 1186 to which a play implement 1160 is releasably coupled.

A housing 1140 is coupled to the support 1130. Proximate to the housing 1140 is a pivotally mounted loader 1150. The loader 1150 includes an upper end 1152, a lower end 1154, a body 1156, and an opening 1158 through which a play implement can be removed. The loader 1150 includes an opening 1151 proximate to upper end 1152 through which play implements can be inserted into the loader 1150.

As illustrated in FIG. 25, the positioning device 1100 includes an actuator 1190 with receptacles 1192 and 1194 which can be manipulated by a batter to move the loader 1150 between a non-load position and a load position. The actuator 1190 can be referred to as a movable member. The actuator or movable member 1190 includes a first portion that defines receptacle 1192 and a second portion that defines receptacle 1194. In other embodiments, the positioning device can include one or more different components that can be used to move the loader 1150 between its positions. For example, one or more levers can be provided so that a user can push or pull the lever to cause movement of the loader 1150.

Figure 26:
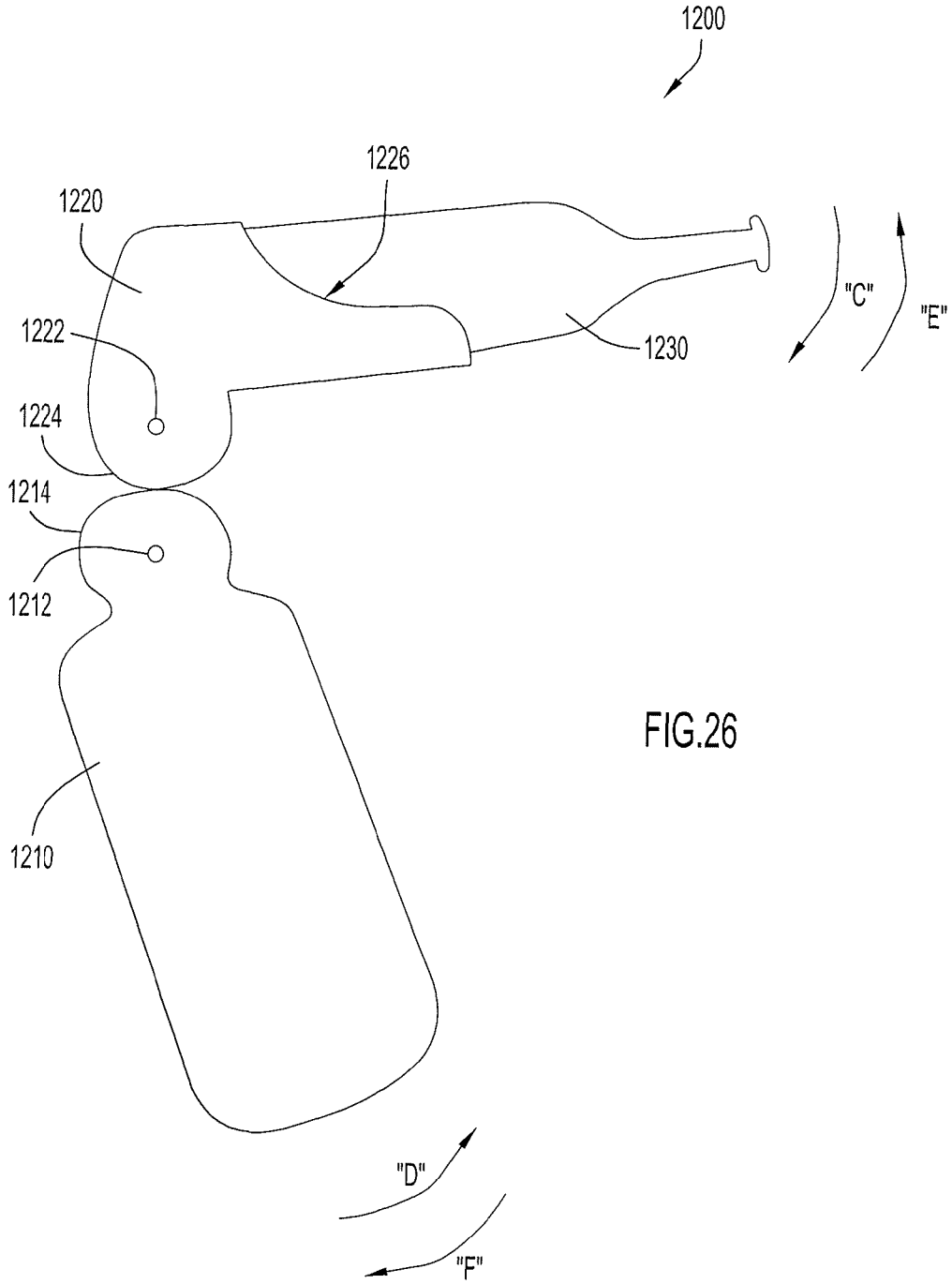
FIG. 26 illustrates an embodiment of an actuator mechanism that can be used with a play implement positioning device.

An embodiment of an actuating mechanism according to the present invention is illustrated in FIG. 26. This embodiment is exemplary of an actuating mechanism that can be used with a manually operable play implement positioning device. In this embodiment, actuating mechanism 1200 includes a loader 1210 that is pivotally mounted about an axis 1212 and that includes a cam surface 1214. Actuating mechanism 1200 also includes an actuator 1220 that is pivotally mounted about an axis 1222 and that includes a cam surface 1224 that is configured to engage the cam surface 1214 of the loader 1210. The actuator 1220 includes a receptacle 1226 into which an object, such as a bat 1230, can be inserted.

As the user moves the bat 1230 and as a result, the actuator 1220, along the direction of arrow "C," the engagement of the cam surfaces 1214 and 1224 causes the loader 1210 to pivot about axis 1212 and move along the direction of arrow "D" from its non-load position to its load position. As the user moves the actuator 1220 along the direction of arrow "E," the engagement of the cam surfaces 1214 and 1224 causes the loader 1210 to pivot about axis 1212 and move along the direction of arrow "F" from its load position to its non-load position.

Figure 27:
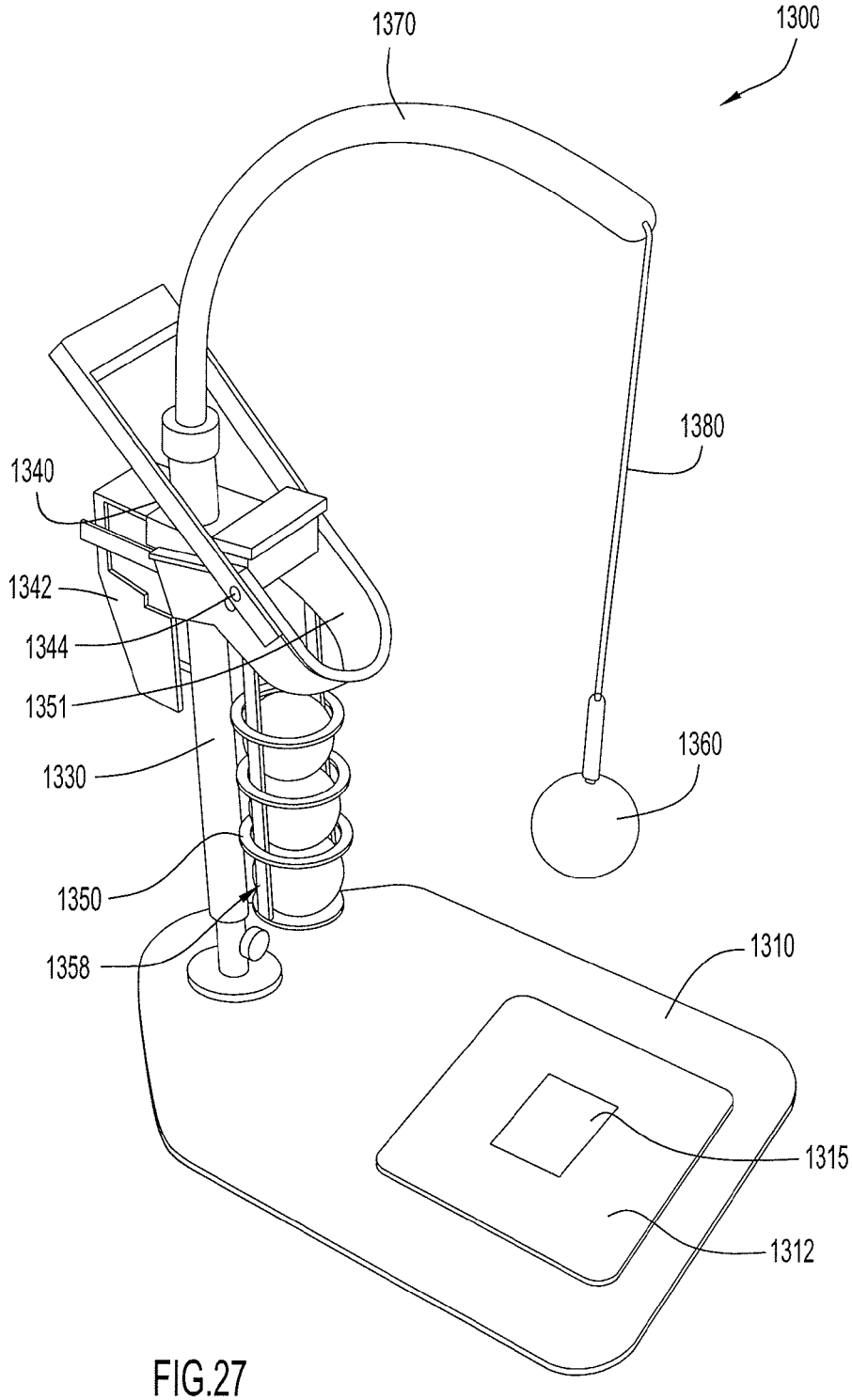
FIG. 27 illustrates an alternative embodiment of a play implement positioning device according to the present invention in a non-load configuration.

An alternative embodiment of a play implement positioning device is illustrated in FIG. 27. In this embodiment, the positioning device 1300 includes a base 1310 with a plate 1312 coupled thereto. The base 1310 includes a switch 1315, the function of which is described in detail below. The positioning device 1300 includes a support 1330 to which a housing 1340 and a support member or support arm 1370 are coupled. A flexible or elongate member 1380 is coupled to the support member 1370 and a play implement 1360 is releasably coupled to the flexible member 1380.

In this embodiment, the positioning device 1300 includes a drive mechanism 1342 that is operably coupled to a loader 1350 that is pivotally mounted about axis 1344. The loader 1350 includes an opening 1351 into which play implements can be inserted and an opening 1358 through which play implements can be removed from the loader 1350. The switch 1315 is connected to the drive mechanism 1342 so that when a user presses or steps on the switch 1315, the drive mechanism 1342 is activated and the loader 1350 is moved from its non-load position to its load position.

Figure 28:
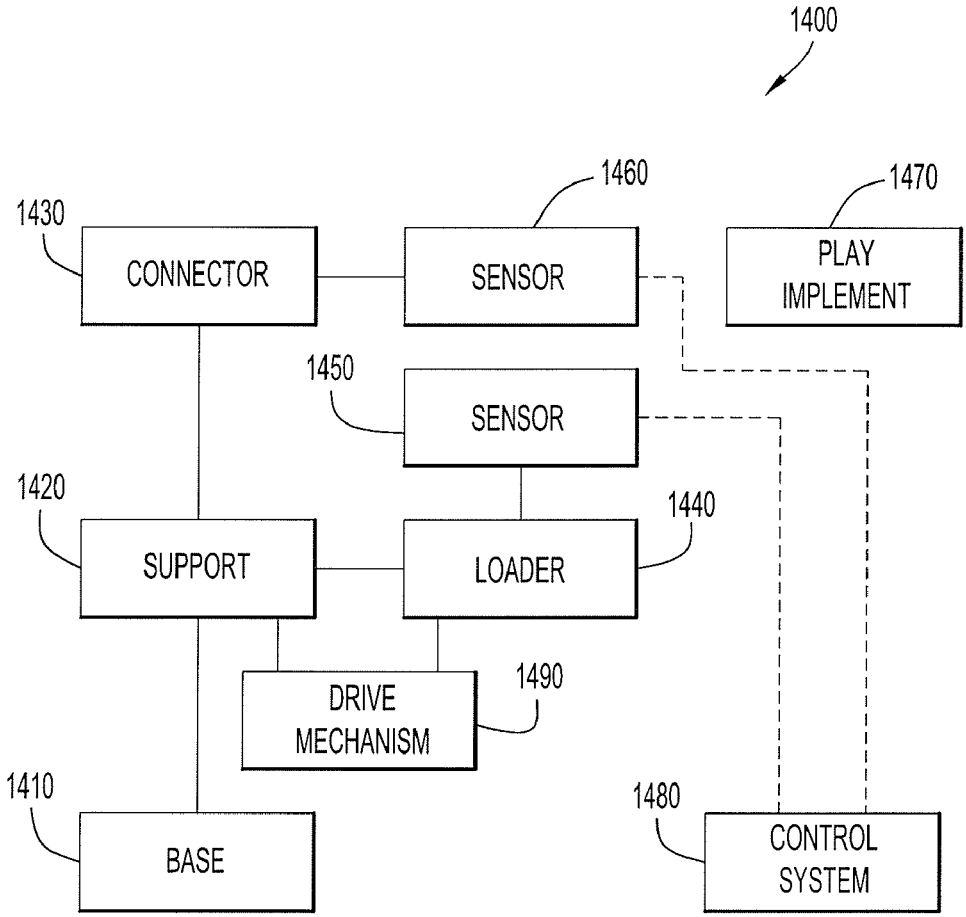
FIG. 28 illustrates a functional block diagram of some components of an alternative embodiment of a play implement positioning device according to the present invention.

A functional block diagram of an alternative embodiment of a play implement positioning device is illustrated in FIG. 28. In this embodiment, components are represented as functional blocks and can have any shape or configuration. As illustrated, the positioning device 1400 includes a base 1410, a support 1420, and a connector 1430. Coupled to the support 1420 is a loader 1440 which, as described relative to the previously described embodiments, is movably mounted to the support 1420. The device 1400 includes a drive mechanism 1490 which is configured to move the loader 1440.

In this embodiment, one or more sensors or detectors can be provided on the play implement positioning device to provide controlled automatic ball loading. The term "automatic ball loading" is intended to include a user activating a switch to connect a ball to the support. As shown, the positioning device 1400 can include a sensor 1460 proximate to or coupled to the connector 1430 that can be used to detect the presence of a play implement 1470 coupled to the connector 1430. In one implementation, the sensor 1460 can be a contact switch that is closed when a play implement 1470 is present. In this embodiment, the positioning device 1400 also includes a sensor 1450 that is associated with the loader 1440. Sensor 1450 is used to detect the presence of a play implement in the loader 1440. In one embodiment, the sensor 1450 can be located within the loader 1440. In this embodiment, the sensors 1450 and 1460 are illustrated as being electrically connected, and forming a part of, a controller or control system 1480.

When the play implement 1470 is contacted and disconnected from the connector 1430, the sensor 1460 is activated and a signal is sent to a controller or control system 1480 that indicates that no play implement 1470 is present at the connector 1430. The controller or control system 1480 is configured so that it then determines via sensor 1450 whether another play implement is present in the loader 1440. If another play implement is present in the loader 1440, the signal generated based on the input from sensor 1460 activates the drive mechanism 1490 which causes the movement of the loader 1440 to reload another play implement on the connector 1430.

In another embodiment, the electronic system can be configured so that a play implement or ball is loaded after a period of time. In this arrangement, the loader is moved from its non-load position to its load position to load another play implement on the connector after a period of time has elapsed. For example, another play implement can be loaded on to the connector every five seconds. This arrangement provides automatic timed loading with an interval of time during which a player can hit the supported play implement and get ready to hit the next loaded play implement. In one embodiment, the drive mechanism can be activated after a pre-determined period of time has elapsed provided that another play implement is available to be loaded. The availability of that play implement can be determined by a sensor that is associated with the loader and in particular, with the storage member.

Figure 29:
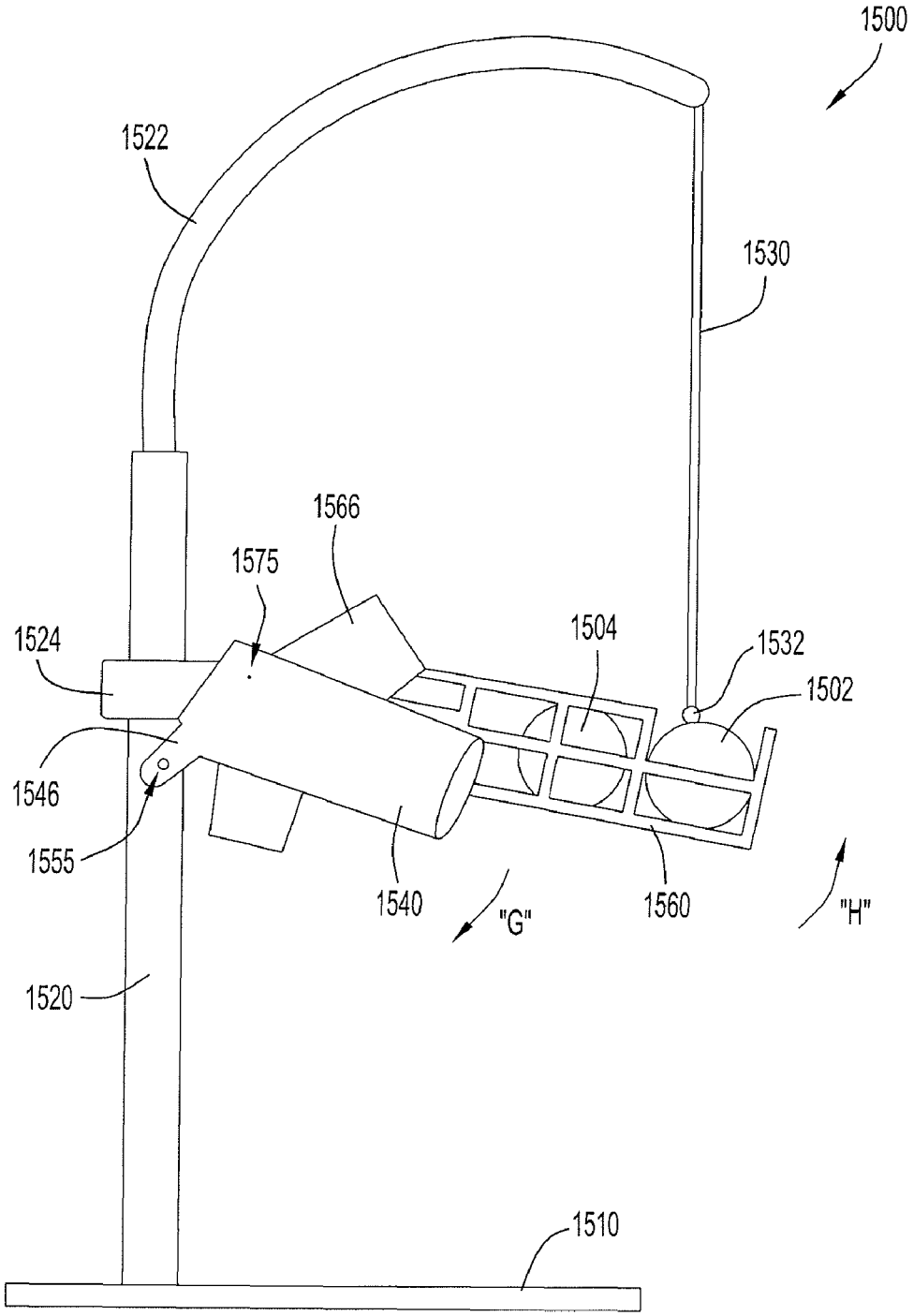
FIG. 29 illustrates a side view of an alternative embodiment of a play implement positioning device according to the present invention.

An alternative embodiment of a play implement positioning device according to the present invention is illustrated in FIGS. 29-33. As shown in FIG. 29, the positioning device 1500 includes a base 1510 with a support or implement support 1520 and a support member or support arm 1522 coupled thereto. A flexible member 1530 is connected to the support member 1522 and has a connector or gripper 1532 proximate to its lower end. Mounted to the support 1520 is a collar or housing 1524, which is fully illustrated in FIG. 30. The housing 1524 includes a hole into which a connector can be inserted, as described below.

Figure 30:
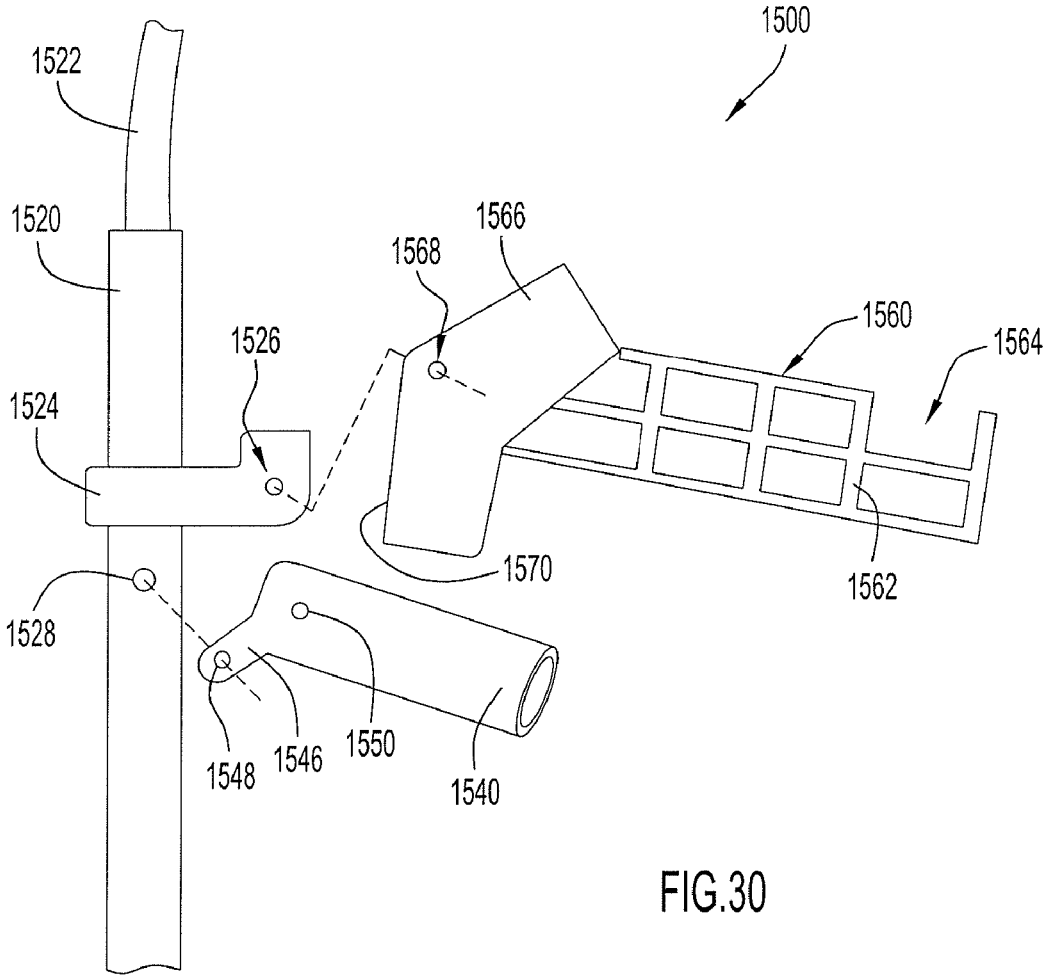
FIG. 30 illustrates an exploded side view of some of the components of the play implement positioning device illustrated in FIG. 29.

In this embodiment, positioning device 1500 includes a loader 1560 that has a body 1562 with an opening 1564 proximate to one end. The body 1562 can be referred to as a storage member as well. The body 1562 is configured to receive and retain play implements, such as balls 1502 and 1504. The body 1562 includes a base 1566 that defines a hole 1568. Referring to FIG. 30, a connector or fastener can be inserted through the hole 1568 of loader 1560 and through the hole 1526 of the housing 1524. When coupled to the housing 1524, the loader 1560 is pivotally mounted about an axis 1577 that is defined by the connector extending through holes 1526 and 1568. The base 1566 of the loader 1560 includes a cam surface 1570 (see FIG. 30), the function of which is described below.

Referring to FIGS. 29-32, the positioning device 1500 includes an actuator 1540. Actuator 1540 has an opening at one end 1542 that is in communication with a receptacle 1544. The receptacle 1544 is configured to receive a portion of a bat or other opening therein. The actuator 1540 also includes an extension 1546 that has a hole 1548 formed therein. A connector or fastener can be inserted through hole 1548 and into hole 1528 on support 1520 to pivotally mount the actuator 1540 to the support 1520. When the actuator 1540 is coupled to the support 1520, the actuator 1540 is pivotally mounted for movement about an axis 1555.

Figure 31:
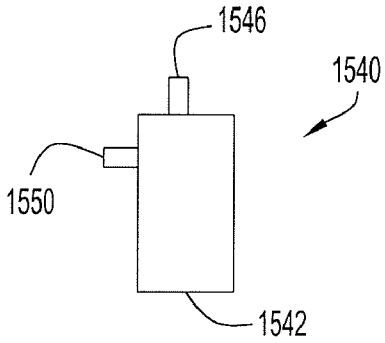
FIG. 31 illustrates a top view of an embodiment of an actuator.
Figure 32:
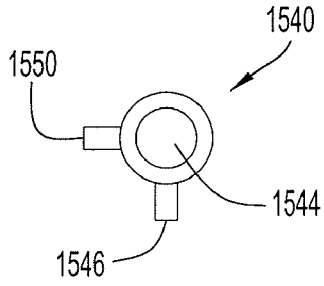
FIG. 32 illustrates an end view of the actuator of FIG. 31.

Referring to FIGS. 31 and 32, the actuator 1540 includes a cam member or projection 1550 that extends outwardly from the body of the actuator 1540. The cam member 1550 is integrally formed with the body of the actuator 1540. In other embodiments, the cam member 1550 can be formed separately from and subsequently coupled to the body of the actuator 1540.

Figure 33:
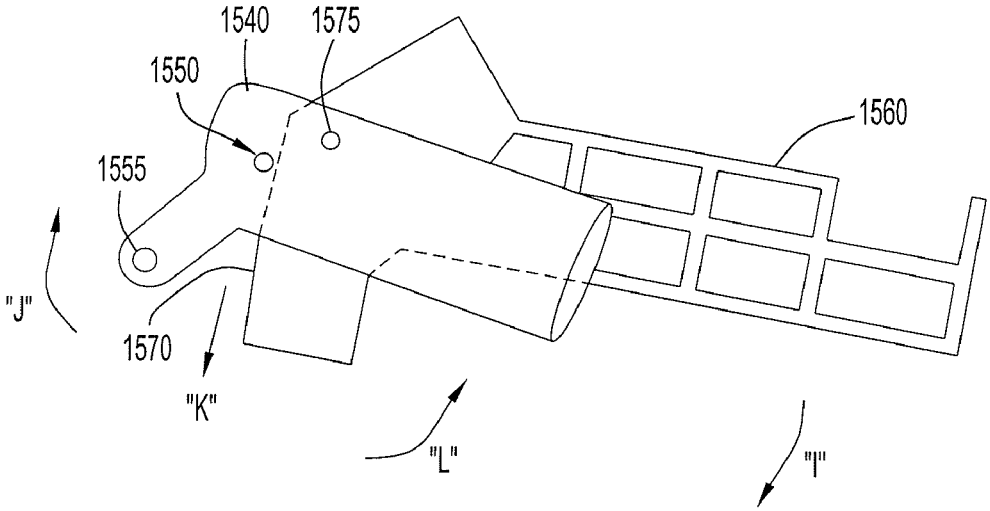
FIG. 33 illustrates a side view of some of the components of the play implement positioning device illustrated in FIG. 29.

Referring to FIGS. 29 and 33, the operation of the positioning device 1500 is illustrated. As shown in FIG. 29, as the player moves the actuator 1540 along the direction of arrow "G," the loader 1560 moves along the direction of arrow "H"

from its non-load position to its load position. As shown in FIG. 33, as the player moves the actuator 1540 along the direction of arrow "I," the actuator 1540 rotates or pivots about axis 1555 along the direction of arrow "J." During such movement, the cam member 1550 rotates about axis 1555 and moves along cam surface 1570 of the loader 1560 along the direction of arrow "K." As a result, the actuator 1560 rotates or pivots about axis 1575 along the direction of arrow "L." When a user releases the force applied to the bat or other object inserted into the actuator 1540, the actuator 1540 and the loader 1560 rotate in the directions opposite to those identified above.

In other embodiments, the movement of the loader of the positioning device can be in a direction other than a rotating or pivoting direction. For example, a loader can move between its load position and its non-load position in a linear manner. In other embodiments, any combination of inputs, such as switches, can be used to control some or all of the functionality of the play implement positioning device.

In other embodiments, the activation of the loading mechanism can be achieved using any type of switch to control the communication as described above, including wireless communications. The shape and configuration of the loader can vary in other embodiments so long as a play implement can be easily loaded into and unloaded from it. For, example a storage member can pivot a play implement downwardly from above. While most of the components of the system are molded of plastic, other materials can be used.

Thus, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer," and the like as may be used herein, merely describe points of reference and do not limit the present invention to any particular orientation or configuration.

We claim:

1. An implement positioning device comprising:

a base;

an implement support including a first end connected to said base and a second end, the second end including an implement connector attached thereto; a play implement coupleable to the implement connector to connect the play implement to the implement support; and a loader including a base connector and a storage member, the loader connected to the base via the base connector, the storage member including a tubular space sized to receive the play implement, and having a first end pivotally connected to the base connector and a second end, the storage member being pivotable about the base such that the second end of the storage member is moved upwardly so that it is positionable within proximity of the implement connector, wherein when the play implement is proximate to the second end of the storage member and the storage member is pivoted so that its second end is disposed proximate to the implement connector, the play implement is coupled to the implement connector.

2. The implement positioning device of claim 1, wherein the implement support includes a suspension arm and a flexible member, the suspension arm includes a first end connected to the base and includes a second end, the flexible member includes a first end connected to the second end of the suspension arm and a second end to which the implement connector is connected.

3. The implement positioning device of claim 2, wherein the base includes a support surface engagement member and an elevation member, the elevation member being adjustable to elevate the suspension arm and the base connector relative to the support surface engagement member.

4. The implement positioning device of claim 3, wherein the elevation member includes an upper post arranged telescopically with respect to a lower post, the second end of the implement support and the base connector being connected to the upper post and the lower post is connected to the support surface engagement member.

5. The implement positioning device of claim 4, wherein the adjustment of the elevation member includes adjusting the upper post relative to the lower post.

6. The implement positioning device of claim 1, wherein the implement connector is a first implement connector, the play implement including a second implement connector that is coupleable to the first implement connector to connect the play implement to the first implement connector.

7. The implement positioning device of claim 1, wherein the storage member includes an opening in communication with the tubular space, the tubular space extends to the second end of the storage member, and the play implement is positionable in the tubular opening and passable to the second end of the storage member within the tubular space.

8. The implement positioning device of claim 1, wherein the storage member is pivotable between a first position in which the second end of the storage member is proximate to the implement connector and a second position in which the second end of the storage member is spaced apart from the implement connector.

9. The implement positioning device of claim 8, further comprising:

a drive mechanism, the drive mechanism being coupled to the storage member and configured to cause the storage member to move between the first position and the second position;

a first sensor, the first sensor being configured to determine when a first implement is detached from the implement connector; and a second sensor, the second sensor being associated with the storage member, the second sensor being configured to determine whether a second implement is present in the storage member, the drive mechanism being activated to move the storage member from the second position to the first position when the first sensor determines that the first implement is detached and the second sensor determines that a second implement is present in the storage member, the second implement being coupleable to the implement connector when the storage member is in the first position.

10. The implement positioning device of claim 8, further comprising:

a drive mechanism, the drive mechanism being coupled to the storage member and configured to cause the storage member to move between the first position and the second position; and a control system, the control system being connected to the drive mechanism, the control system being configured to determine when a first play implement has been hit and when a second play implement can be loaded.

11. The implement positioning device of claim 10, wherein the control system includes a first sensor that is configured to determine when the first play implement is detached from the implement connector of the implement support.

12. The implement positioning device of claim 11, wherein the control system includes a second sensor that is configured to determine when the second play implement is present in the storage member of the loader, the control system being configured to activated the drive mechanism when the second play implement is present and the first play implement has been detached.

13. The implement positioning device of claim 8, further comprising:

a drive mechanism, the drive mechanism being coupled to the storage member and configured to cause the storage member to move between the first position and the second position; and a control system, the control system being connected to the drive mechanism, the control system being configured to activated the drive mechanism to move the storage member after a pre-determined period of time.

14. The implement positioning device of claim 13, wherein the control system repeatedly activates the drive mechanism to reload an additional play implement after each pre-determined period of time elapsed provided that the additional play implement is present in the storage member.

15. The implement positioning device of claim 8, wherein the loader includes a motor and an arm, the motor is connected to the arm and the arm is connected to the storage member, and during operation, the motor transfers a force to the arm and the arm transfers a force to the storage member to pivot the storage member relative to the base connector.

16. The implement positioning device of claim 15, wherein the arm includes a rigid arm portion and a flexible arm portion, the rigid arm portion being connected to the flexible arm portion.

17. The implement positioning device of claim 16, wherein the flexible arm portion is a spring.

18. The implement positioning device of claim 15, further comprising:

an actuator, the actuator being located in the base and configured so that when the actuator is pressed, the motor is operated to pivot the storage member from the first position to the second position.

19. The implement positioning device of claim 1, further comprising;

an actuator, the actuator being supported on the implement support, the actuator including a movable member, the movable member being configured to be moved by a player to cause movement of the storage member from a non-load position to a load position.

20. The implement positioning device of claim 19, wherein the movable member includes a receptacle configured to receive an object therein, the movable member and the object being configured to be utilized as a lever to move the storage member between the non-load position to a load position.

21. The implement positioning device of claim 19, wherein the movable member is pivotally supported by the implement support and the storage member is pivotally supported by the implement support.

22. The implement positioning device of claim 19, wherein the movable member includes a cam member, the storage member includes a cam surface, and the cam member is configured to engage the cam surface of the storage member so that movement of the movable member causes movement of the storage member.

23. The implement positioning device of claim 19, wherein the movable member includes a first portion that defines a first receptacle and a second portion that defines a second receptacle, the first receptacle being located on one side of the implement support and the second receptacle being located on an opposite side of the implement support.

24. An implement positioning device comprising:

a base;

an implement support including a first end connected to the base and a second end, the second end including an implement connector attached thereto;

a loader including a base connector and a storage member, the loader connected to the base via the base connector, the storage member including a tubular space and having a first end pivotally connected to the base connector and a second end, the storage member being pivotable about the base such that the second end of the storage member is moved upwardly so that it is positionable within proximity of the implement connector; and an actuator, the actuator being supported on the implement support, the actuator including a movable member, the movable member being configured to be moved by a player to cause movement of the storage member from a non-load position to a load position.

25. The implement positioning device of claim 24, further comprising a drive mechanism, the drive mechanism being coupled to the storage member and configured to cause the storage member to move between the non-load position and the load position when the movable member is moved.

26. The implement positioning device of claim 24, wherein the loader includes an arm, the actuator is connected to the arm and the arm is connected to the storage member, and during operation, movement of the movable member transfers a force to the arm and the arm transfers a force to the storage member to pivot the storage member relative to the base connector.

27. The implement positioning device of claim 24, wherein the implement support includes a suspension arm and a flexible member, the suspension arm includes a first end connected to the base and includes a second end, the flexible member includes a first end connected to the second end of the suspension arm and a second end to which the implement connector is connected.

28. The implement positioning device of claim 24, wherein the base includes a support surface engagement member and an elevation member, the elevation member being adjustable to elevate the implement support relative to the support surface engagement member.

29. The implement positioning device of claim 24, wherein the implement connector is a first implement connector, the device further comprising a play implement, the play implement including a second implement connector that is coupleable to the first implement connector to connect the play implement to the first implement connector.

30. An implement positioning device comprising:

a base;

an implement support including a first end connected to the base and a second end, the second end including an implement connector attached thereto, the implement support depending from the base;

a loader including a base connector and a storage member, the loader connected to the base via the base connector, the storage member including a tubular space and having a first end pivotally connected to the base connector and a second end, the storage member being pivotable about the base such that the second end of the storage member is moved upwardly so that it is positionable within proximity of the implement connector; and an actuator supported on the implement support, the actuator including a movable member configured to be moved by a player to cause movement of the storage member from a non-load position to a load position, wherein the movable member is pivotally supported by the implement support and the storage member is pivotally supported by the implement support.

31. The implement positioning device of claim 30, wherein the implement support includes a suspension arm and a flexible member, the suspension arm includes a first end connected to the base and includes a second end, the flexible member includes a first end connected to the second end of the suspension arm and a second end to which the implement connector is connected.

32. The implement positioning device of claim 30, wherein the implement connector is a first implement connector, the device further comprising a play implement, the play implement including a second implement connector that is coupleable to the first implement connector to connect the play implement to the first implement connector.

* * * * *